US009792925B2

(12) United States Patent
Sugiyama

(10) Patent No.: US 9,792,925 B2
(45) Date of Patent: Oct. 17, 2017

(54) SIGNAL PROCESSING DEVICE, SIGNAL PROCESSING METHOD AND SIGNAL PROCESSING PROGRAM

(75) Inventor: Akihiko Sugiyama, Toyko (JP)

(73) Assignee: NEC CORPORATION, Tokyo (JP)

( * ) Notice: Subject to any disclaimer, the term of this patent is extended or adjusted under 35 U.S.C. 154(b) by 324 days.

(21) Appl. No.: 13/988,673

(22) PCT Filed: Nov. 21, 2011

(86) PCT No.: PCT/JP2011/077283

§ 371 (c)(1),
(2), (4) Date: May 21, 2013

(87) PCT Pub. No.: WO2012/070668

PCT Pub. Date: May 31, 2012

(65) Prior Publication Data

US 2013/0246056 A1 Sep. 19, 2013

(30) Foreign Application Priority Data

Nov. 25, 2010 (JP) ..... 2010-263023

(51) Int. Cl.
*G10L 21/003* (2013.01)
*G10L 21/02* (2013.01)
*G10L 21/0208* (2013.01)

(52) U.S. Cl.
CPC ..... *G10L 21/003* (2013.01); *G10L 21/02* (2013.01); *G10L 21/0208* (2013.01)

(58) Field of Classification Search
CPC .... G10L 21/02; G10L 21/003; G10L 21/0208
(Continued)

(56) References Cited

U.S. PATENT DOCUMENTS 5,228,088 A * 7/1993 Kane ..... G10L 21/0208 704/233
5,812,970 A * 9/1998 Chan ..... G10L 21/0208 381/94.3

(Continued)

FOREIGN PATENT DOCUMENTS

DE WO 2010003618 A2 * 1/2010 ..... G10L 19/002
EP 0 459 362 A1 12/1991

(Continued)

OTHER PUBLICATIONS

Communication dated Nov. 4, 2015 from the Japanese Patent Office in counterpart application No. 2012-545812.

(Continued)

*Primary Examiner* — Edwin S Leland, III
(74) *Attorney, Agent, or Firm* — Sughrue Mion, PLLC

(57) ABSTRACT

The purpose of the present invention is to achieve a high-quality signal processing performance. A signal processing device provided with a suppression unit for suppressing a second signal by processing a mixed signal in which a first signal and the second signal are present. The signal processing device is provided with an analysis unit for analyzing, per frequency component, the importance of the first signal contained in the mixed signal, and an inhibition unit for inhibiting the suppression of the second signal of a frequency component having a high importance over a frequency component having a low importance on the basis of the analysis result of the analysis means.

12 Claims, 29 Drawing Sheets

(58) Field of Classification Search
USPC ..... 704/205
See application file for complete search history.

(56) References Cited

U.S. PATENT DOCUMENTS

| | | | | | |
|---|---|---|---|---|---|
| 6,138,093 | A * | 10/2000 | Ekudden | G10L 19/26 | 704/205 |
| 6,980,665 | B2 * | 12/2005 | Kates | G10H 1/125 | 381/312 |
| 7,447,630 | B2 * | 11/2008 | Liu | G10L 21/0208 | 381/71.1 |
| 7,516,067 | B2 * | 4/2009 | Seltzer | G10L 15/20 | 704/226 |
| 8,214,205 | B2 * | 7/2012 | Jang | G10L 21/0208 | 704/205 |
| 9,015,041 | B2 * | 4/2015 | Bayer | G10L 19/002 | 704/201 |
| 2002/0152066 | A1 * | 10/2002 | Piket | G10L 25/78 | 704/226 |
| 2004/0049383 | A1 * | 3/2004 | Kato | G10L 21/0208 | 704/226 |

FOREIGN PATENT DOCUMENTS

| | | | | |
|---|---|---|---|---|
| EP | 0 751 491 | A2 | | 1/1997 |
| EP | 1 349 148 | A1 | | 10/2003 |
| JP | 4-227338 | A | | 8/1992 |
| JP | 8-221092 | A | | 8/1996 |
| JP | 08221092 | A | * | 8/1996 |
| JP | 9-016194 | A | | 1/1997 |
| JP | 2001-513916 | A | | 9/2001 |
| JP | 2002-149200 | A | | 5/2002 |
| JP | 2002-204175 | A | | 7/2002 |
| JP | 2006-178333 | A | | 7/2006 |
| JP | 2006-180392 | A | | 7/2006 |
| JP | 2006-251375 | A | | 9/2006 |
| JP | 4282227 | B2 | | 6/2009 |
| WO | 98/39768 | A1 | | 9/1998 |
| WO | 02/054387 | A1 | | 7/2002 |
| WO | 2009/038136 | A1 | | 3/2009 |

OTHER PUBLICATIONS

Communication dated Jun. 14, 2016, issued by the Japan Patent Office in corresponding Japanese Application No. 2012-545812.

* cited by examiner

SIGNAL PROCESSING DEVICE, SIGNAL PROCESSING METHOD AND SIGNAL PROCESSING PROGRAM

CROSS REFERENCE TO RELATED APPLICATIONS

This application is a National Stage of International Application No. PCT/JP2011/077283 filed Nov. 21, 2011, claiming priority based on Japanese Patent Application No. 2010-263023, filed Nov. 25, 2010, the contents of all of which are incorporated herein by reference in their entirety.

TECHNICAL FIELD

The present invention relates to a signal processing technology for, through processing of a mixed signal in which a first signal and a second signal are mixed, suppressing the second signal.

BACKGROUND ART

There have been well known noise suppressing technologies for, through processing of a mixed signal in which a first signal and a second signal are mixed, suppressing the second signal to output an emphasized signal (a signal resulting from emphasizing a desired signal). For example, a noise suppressor is a system for suppressing noise which is superposed on a desired speech signal. Such a noise suppressor is used in various audio terminals, such as a mobile telephone.

With respect to this kind of technology, in patent literature (PTL) 1, there is disclosed a method of suppressing noise by multiplying amplitude spectrum components of an input noisy speech signal by corresponding spectral gains each having a value smaller than or equal to "1". Further, in PTL 2, there is disclosed a method of suppressing noise by directly subtracting spectrum components of estimated noise from corresponding spectrum components of a noisy speech signal.

CITATION LIST

Patent Literature

[PTL 1] Japanese Patent No. 4282227

[PTL 2] Japanese Unexamined Patent Application Publication No. Hei 8-221092

SUMMARY OF INVENTION

Technical Problem

Nevertheless, in the method disclosed in PTL 1 described above, noise included in the input noisy speech signal is suppressed by using noise information which is estimated regardless of whether or not the input noisy speech signal includes important signal components. For this reason, there has been a problem that, with respect to important signal components, when an estimated amplitude-spectrum component value of noise is larger than an actual amplitude-spectrum component value thereof, an output amplitude-spectrum component value is reduced below a proper amplitude-spectrum component value, so that listeners sometimes perceive a distortion instead of noise. In particular, it has been a problem that, when processing on important frequency components of a desired signal results in degradation of a signal quality thereof, listeners perceive a serious degradation of a sound quality instead of noise.

In view of the above, an object of the present invention is to provide a signal processing technology which makes it possible to solve the aforementioned problems.

Solution to Problem

A signal processing device according to one exemplary embodiment of the present invention includes: a suppression means for suppressing a second signal included in a mixed signal in which a first signal and said second signal are mixed; and an analysis means for determining an importance degree of said first signal included in said mixed signal for each of frequency components; and an inhibition means for, on the basis of a result of said determination made by said analysis means, inhibiting said suppression of said second signal for each of frequency components such that said suppression thereof corresponding to at least one frequency component having a high importance degree among said frequency components is inhibited to a greater degree, as compared with said suppression thereof corresponding to at least one frequency component having a low importance degree among said frequency components.

A signal processing method according to one exemplary embodiment of the present invention includes the steps of: determining an importance degree of a first signal included in a mixed signal, in which said first signal and a second signal are mixed, for each of frequency components; and when suppressing said second signal included in said mixed signal for each of frequency components, inhibiting said suppression of said second signal such that said suppression thereof corresponding to at least one frequency component having a high importance degree among said frequency components is inhibited to a greater degree, as compared with said suppression thereof corresponding to at least one frequency component having a low importance degree among said frequency components.

A signal processing program that causes a computer to execute processing according to the present invention includes the program of: a suppression step of suppressing a second signal by processing a mixed signal in which a first signal and said second signal are mixed; and an analysis step of determining an importance degree of said first signal included in said mixed signal for each of frequency components; and an inhibition process of inhibiting said suppression of said second signal for each of frequency components on the basis of a result of said determination in said analysis step such that said suppression thereof corresponding to at least one frequency component having a high importance degree among said frequency components is inhibited to a greater degree, as compared with said suppression thereof corresponding to at least one frequency component having a low importance degree among said frequency components.

Advantageous Effects of Invention

According to some aspects of the present invention, it is possible to realize signal processing with high quality.

DESCRIPTION OF EMBODIMENTS

Hereinafter, exemplary embodiments of the present invention will be illustratively described in detail with reference to the drawings. It is to be noted here that components described in the following exemplary embodiments are just exemplifications, and it is not intended to limit the technological scope of the present invention to only those components.

First Exemplary Embodiment

A signal processing device 100 as a first exemplary embodiment of the present invention will be described using FIG. 1. The signal processing device 100 is a device for, through processing of a mixed signal in which a first signal and a second signal are mixed, suppressing the second signal.

Figure 1:
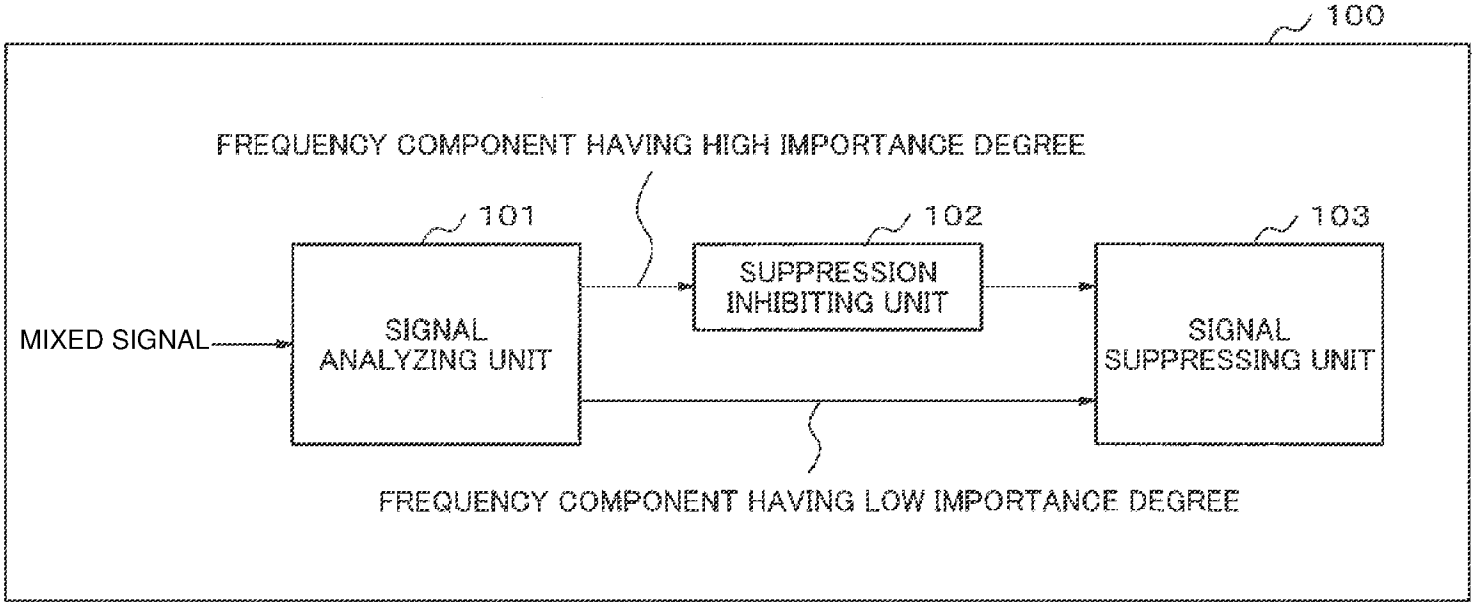
FIG. 1 is a block diagram illustrating a configuration of a signal processing device according to a first exemplary embodiment of the present invention.

As shown in FIG. 1, the signal processing apparatus 100 includes a signal analyzing unit 101, a suppression inhibiting unit 102 and a signal suppressing unit 103. The signal analyzing unit 101 determines an importance degree of the first signal included in the mixed signal for each frequency component. On the basis of a result of the determination, the suppression inhibiting unit 102 inhibits the suppression of the second signal with respect to frequency components each having a high importance degree to a greater degree, as compared with that with respect to frequency components each having a low importance degree. The signal suppressing unit 103 suppresses the second signal by processing the mixed signal.

In such a configuration as described above, it is possible to realize signal processing with high quality by leaving important signal components as they are.

Second Exemplary Embodiment

A noise suppression device 200 as a second exemplary embodiment of the present invention will be described using FIGS. 2 to 11. The noise suppression device 200 of this exemplary embodiment also functions as part of a device, such as a digital camera, a laptop computer and a mobile telephone, but the present invention is not limited to this type of device, and can be applied to any kind of signal processing device for which noise removal from an input signal is required.

<Entire Configuration>

Figure 2A:
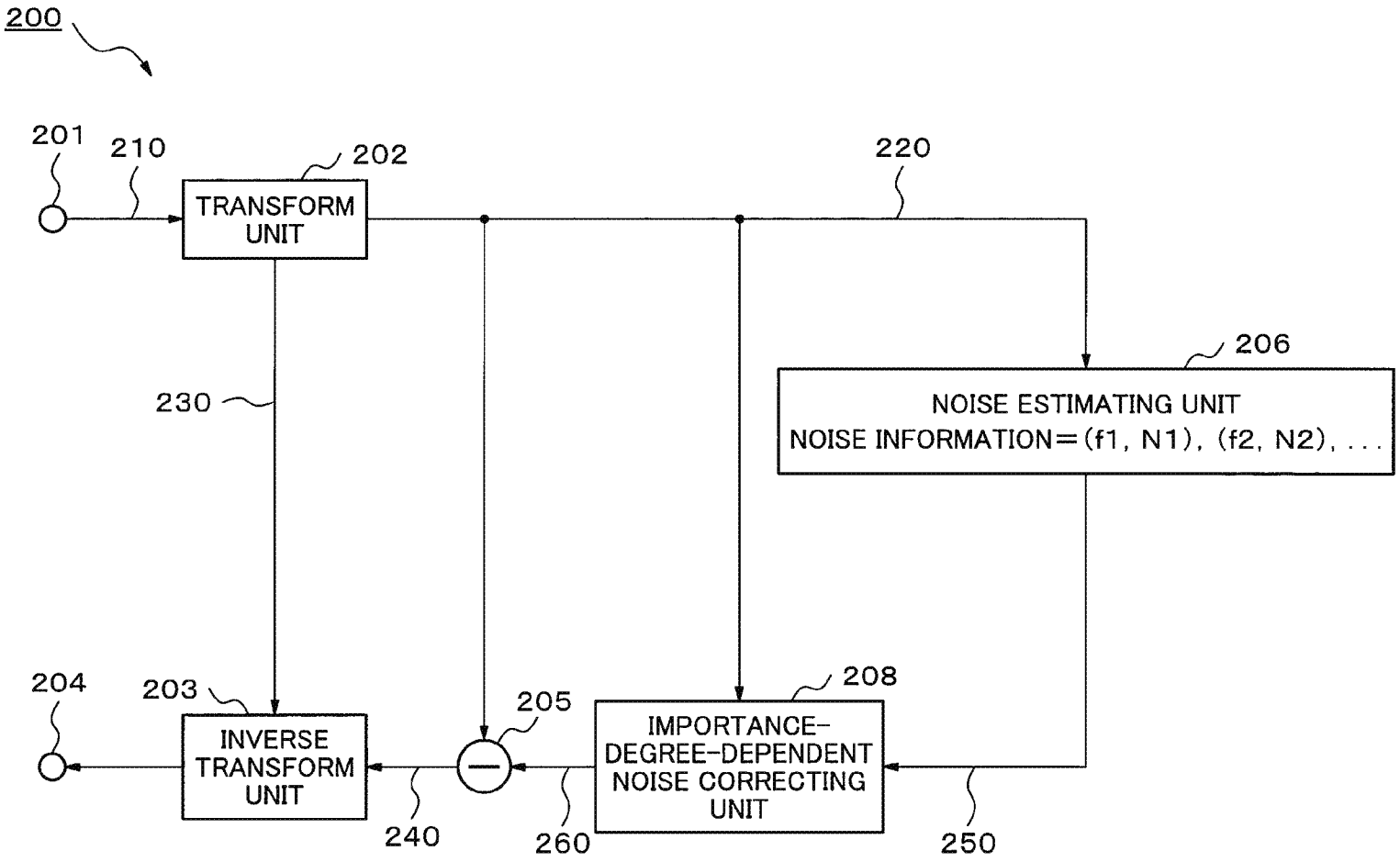
FIG. 2A is a block diagram illustrating a configuration of a noise suppression device according to a second exemplary embodiment of the present invention.

FIG. 2A is a block diagram illustrating the entire configuration of the noise suppression device 200. As shown in FIG. 2, the noise suppression device 200 includes, besides an input terminal 201, a transform unit 202, an inverse transform unit 203 and an output terminal 204, a noise suppressing unit 205, a noise estimating unit 206 and an importance-degree-dependent noise correcting unit 208. A noisy speech signal (a mixed signal in which a desired signal as the first signal and noise as the second signal are mixed) is supplied to the input terminal 201 as a sequence of sample values. The noisy speech signal, which is supplied to the input terminal 201, is subjected to transformation, such as Fourier transform, and is decomposed into a plurality of frequency components in the transform unit 202. The plurality of frequency components is independently processed for respective frequency bins. Here, description will be continued focusing on a specific frequency component. An amplitude spectrum (an amplitude component) of a specific frequency component, that is, a noisy speech signal amplitude spectrum 220, is supplied to the noise suppressing unit 205, and a phase spectrum thereof (a phase component), that is, a noisy speech signal phase spectrum 230, is supplied to the inverse transform unit 203. In addition, although, here, the noisy speech signal amplitude spectrum 220 is supplied to the noise suppressing unit 205, the present invention is not limited to this configuration, but a power spectrum, which is equivalent to the square thereof, may be supplied to the noise suppressing unit 205.

The noise estimating unit 206 estimates noise by using the noisy speech signal amplitude spectrum 220 supplied from the transform unit 202, and generates noise information 250 as an estimated second signal. Further, the importance-degree-dependent noise correcting unit 208 corrects noise for each importance degree of a signal by using the noisy speech signal amplitude spectrum 220 supplied from the transform unit 202 and the generated noise information 250. The importance degree of a signal is determined depending on how much degree a corresponding spectrum amplitude is likely to be perceived. That is, the importance-degree-dependent noise correcting unit 208 can also determine the importance degree, not only on the basis of a spectrum amplitude itself, but also in view of masking due to signal components at neighboring frequency bins. Further, with respect to each of important frequency component signals, the importance-degree-dependent noise correcting unit 208 corrects noise therein such that a suppressed noise level becomes small. That is, the importance-degree-dependent noise correcting unit 208 reduces a noise suppression degree.

Corrected noise 260, which is noise information resulting from the correction, is supplied to the noise suppressing unit 205, and then, is subtracted from the noisy speech signal amplitude spectrum 220, so that a resultant signal is supplied to the inverse transform unit 203 as an emphasized signal amplitude spectrum 240. The inverse transform unit 203 synthesizes the noisy speech signal phase spectrum 230 supplied from the transform unit 202, and the emphasized signal amplitude spectrum 240, inverse transforms the synthesized signal, and supplies the inverse-transformed signal to the output terminal 204 as an emphasized signal.

<Configuration of Importance-Degree-Dependent Noise Correcting Unit>

FIGS. 2B to 2G are diagrams illustrating six examples of an internal configuration of the importance-degree-dependent noise correcting unit 208, respectively. The importance-degree-dependent noise correcting unit 208 shown in FIG. 2B includes a signal analyzing unit 251 which detects peaks of noisy speech signal amplitude-spectrum components as importance degree information, and a noise correcting unit 252 which performs correction such that noise information levels become small at the respective spectrum peaks.

The signal analyzing unit 251 detects the spectrum peaks by comparing a spectrum component at each frequency bin with spectrum components at respective neighboring frequency bins of the each frequency bin, and evaluating whether or not the magnitude of the spectrum component at the each frequency bin is sufficiently large. For example, the signal analyzing unit 251 compares a spectrum component at each frequency bin with respective both adjacent spectrum components (i.e., respective higher and lower frequency side spectrum components), and if spectrum magnitude differences therebetween are larger than threshold values, respectively, the signal analyzing unit 251 determines the spectrum component as a spectrum peak. The spectrum peak detecting threshold values which are used here for the comparison with both side spectrum components are not necessarily equal to each other. In Japanese Industrial Standards: JIS X 4332-3 "Coding of audio-visual objects—Part 3: Audio", March 2002, it is described that making a difference threshold value at a higher frequency side smaller than a difference threshold value at a lower frequency side is matched with human aural characteristic. In the same way as that described in this document, the importance-degree-dependent noise correcting unit 208 can also detect spectrum peaks by obtaining spectrum magnitude differences with respect to a plurality of frequencies at each of higher and lower frequency sides, and synthesizing these obtained pieces of information. That is, in the case where there is detected a certain frequency bin, for which, at each of higher and lower frequency sides, a spectrum magnitude difference with an immediately adjacent frequency bin is large, and further, spectrum magnitude differences between some pairs of two adjacent frequency bins which are arranged in a direction away from the immediately adjacent frequency bin are small, a spectrum component corresponding to the certain frequency bin results in a spectrum peak. The signal analyzing unit 251 supplies the noise correcting unit 252 with the positions (frequency bins) of the spectrum peaks having been detected in this way to.

In addition, the signal analyzing unit 251 does not need to supply all frequency bins having been determined as spectrum peaks to the noise correcting unit 252. For example, the signal analyzing unit 251 may extract only frequency bins corresponding to spectrum peaks which fall within a range starting from a maximum one and covering a given ratio (for example, 80%) number of the whole spectrum peaks which are arranged in descending order in accordance with their respective spectrum amplitude values. Further, the signal analyzing unit 251 may supply only spectrum peaks included in specific frequency bands to the noise correcting unit 252. Examples of such a specific frequency band include a low frequency band. The low frequency band is perceptually important, and a subjective sound quality is improved by reducing noise suppression degrees corresponding to respective spectrum peak components included in the low frequency band. Moreover, in the case where there is a regular peak which regularly appears at intervals of a constant frequency width, or a regular peak which regularly appears at intervals of a constant period of time, the signal analyzing unit 251 may determine frequency bins at which the regular peaks appear as more important frequency bins. Similarly, the signal analyzing unit 251 can detect spectrum peaks by utilizing regular occurrences of peaks in a time axis direction. That is, once it has been determined that a specific frequency bin corresponds to a spectrum peak, afterwards, this frequency bin is highly likely to correspond to a spectrum peak similarly. Utilization of this property makes it possible for the signal analyzing unit 251 to prevent the occurrence of detection failures due to interference from noise and the like by setting, at a frequency bin at which a spectrum peak has been detected once, a detection threshold value for subsequent detections to a value smaller than a usual detection threshold value. Further, during a period of time from a time when a peak component has not been detected after the continuous detections of the peak component, the signal analyzing unit 251 may make a corresponding detection threshold value small. The signal analyzing unit 251 may gradually set this threshold value to a smaller value as a period of time while any peak is not detected becomes longer, and may set this threshold value to a usual threshold value again when the threshold value has become smaller than a constant value.

Figure 2B:
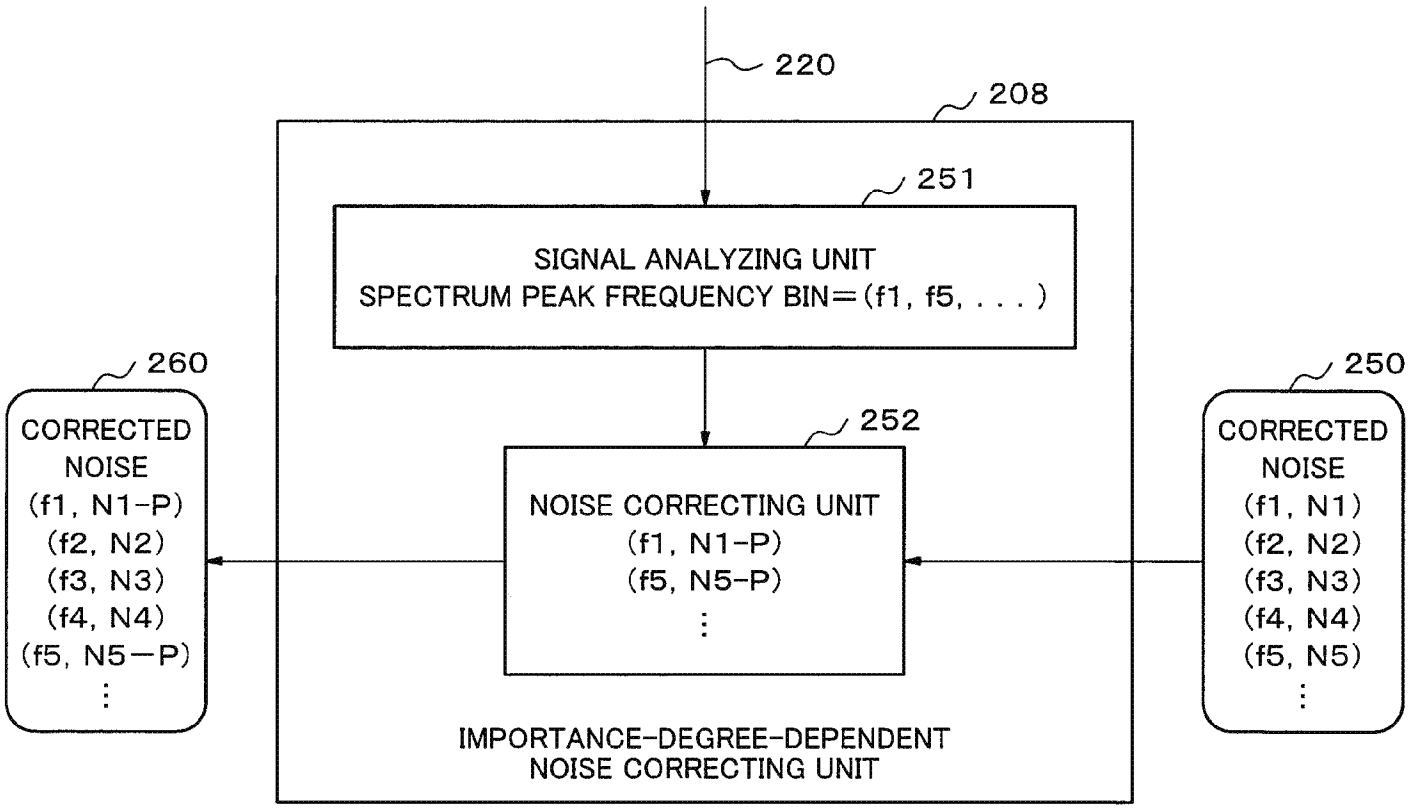
FIG. 2B is a block diagram illustrating an example of a configuration of an importance-degree-dependent noise correcting unit according to a second exemplary embodiment of the present invention.

In FIG. 2B, the noise correcting unit 252 determines spectrum peak frequency bins having been received from the signal analyzing unit 251 as frequency components each having a high importance degree, and subtracts a constant value P from the noise information 250 having been inputted at each of the spectrum peak frequency bins. As a result, the inputted noise information 250 is corrected into the corrected noise 260 shown in FIG. 2B.

Figure 2C:
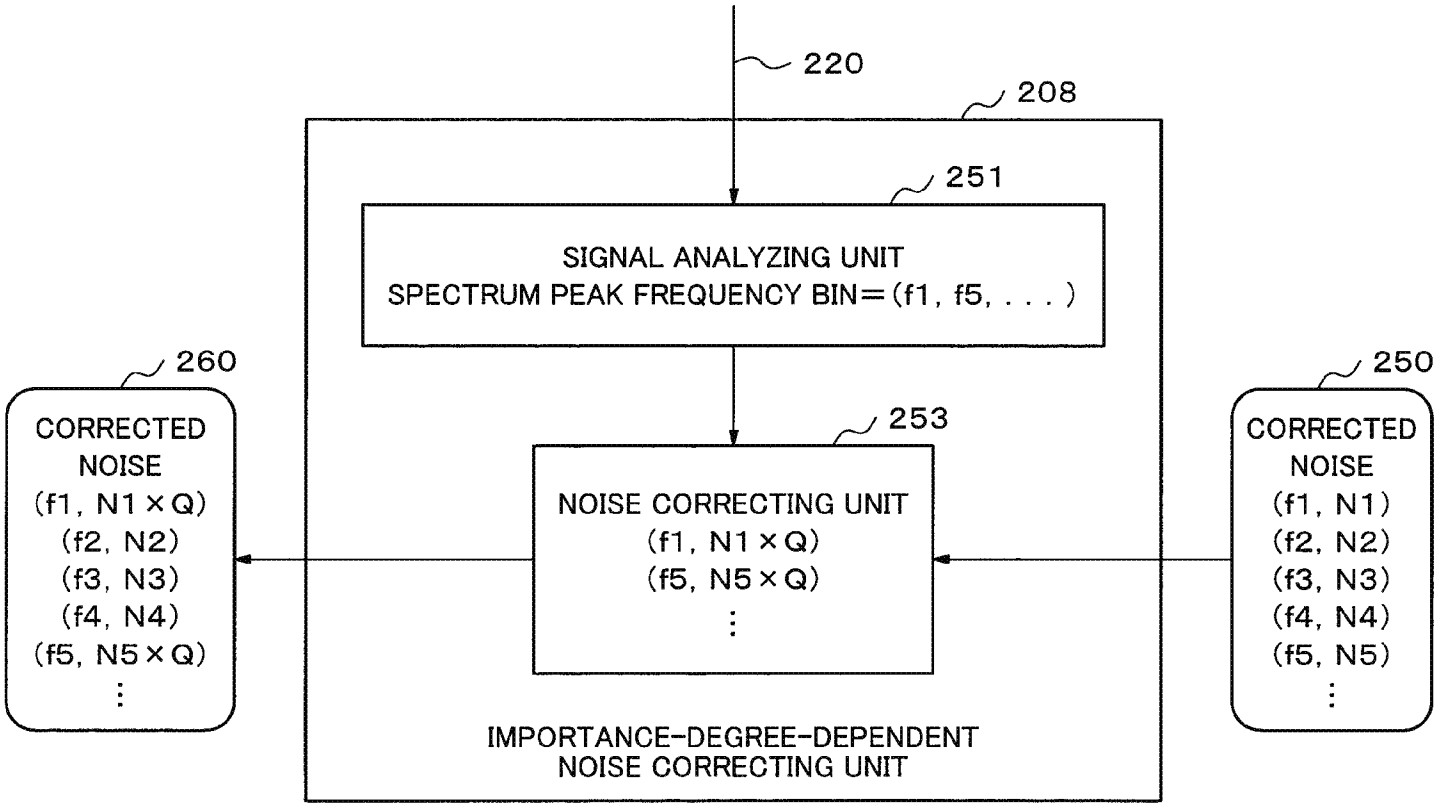
FIG. 2C is a block diagram illustrating an example of a configuration of an importance-degree-dependent noise correcting unit according to a second exemplary embodiment of the present invention.

FIG. 2C illustrates the importance-degree-dependent noise correcting unit 208 provided with a noise correcting unit 253 which performs correction processing different from that shown in FIG. 2B. The noise correcting unit 253 shown in FIG. 2C multiplies the inputted noise information 250 by a constant value Q (Q is a value less than or equal to "1") at spectrum peak frequency bins having been received from the signal analyzing unit 251. As a result, the inputted noise information 250 is corrected into the corrected noise 260 shown in FIG. 2C.

Figure 2D:
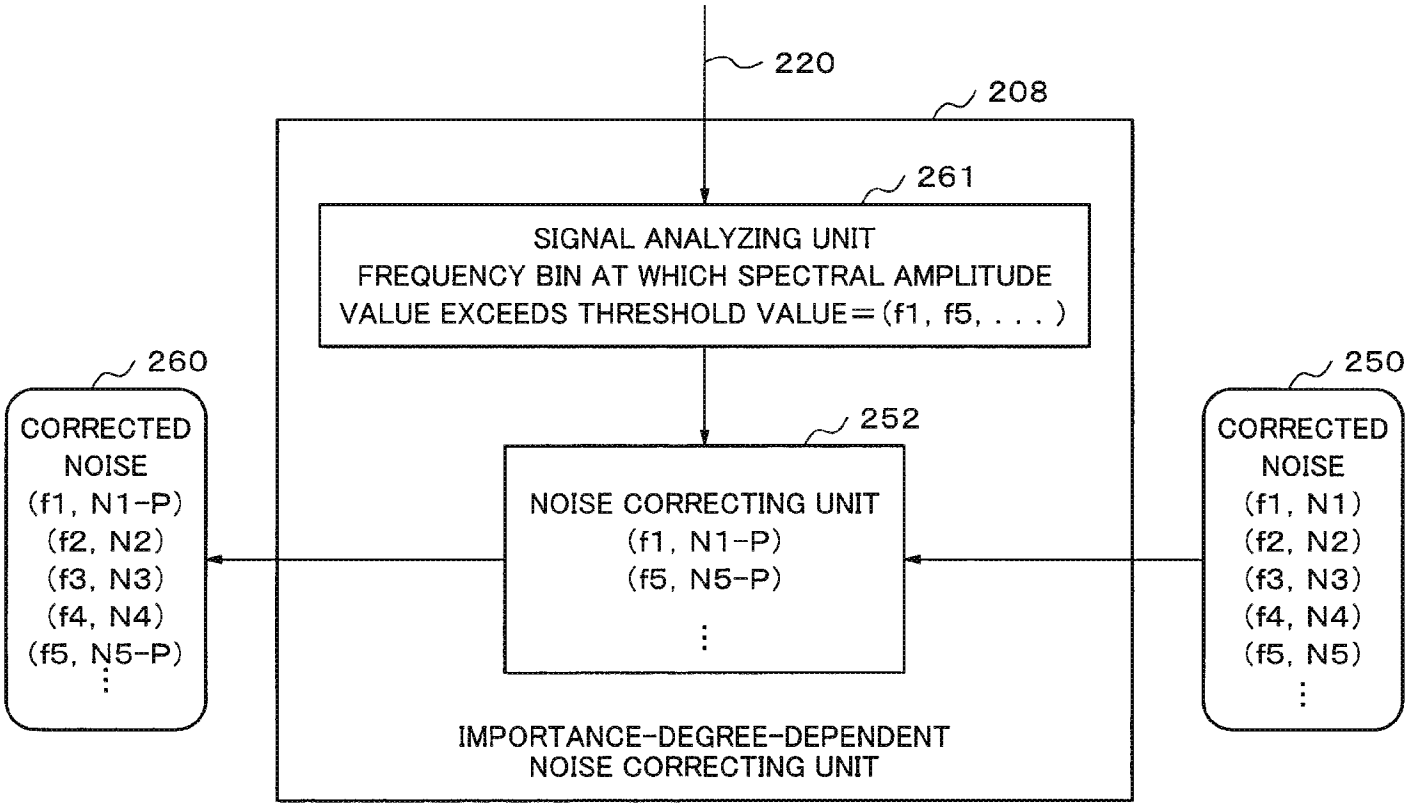
FIG. 2D is a block diagram illustrating an example of a configuration of an importance-degree-dependent noise correcting unit according to a second exemplary embodiment of the present invention.

FIG. 2D illustrates the importance-degree-dependent noise correcting unit 208 provided with a noise analyzing unit 261 which performs signal analysis processing different from that shown in FIG. 2B. The signal analyzing unit 261 shown in FIG. 2D analyzes "the magnitude of a noisy speech signal amplitude spectrum", not just a spectrum peak, as importance degree information. That is, when a spectrum does not form a spectrum peak, but has a large amplitude value (or a power value), the signal analyzing unit 261 determines a frequency bin corresponding thereto as a frequency component having a high importance degree, and detects it. For example, any successive spectrum components, each having a large amplitude value, in a frequency direction are not detected as spectrum peaks, but such a portion is important for a hearing. Thus, the signal analyzing unit 261 supplies the positions (frequency bins) of the detected large spectrum amplitudes to the noise correcting unit 252. Here, the signal analyzing unit 261 determines whether or not a noisy speech signal amplitude spectrum is important by analyzing whether or not the magnitude of the noisy speech signal amplitude spectrum is larger than a predetermined threshold value. The predetermined threshold value is, for example, a mean value of power spectrum values at respective all frequencies, a value which is N times the mean value, or a value which is N times the largest one of amplitude values within a specific frequency band. In particular, when determining a threshold value for each of segmented frequency bands, the signal analyzing unit 261 can detect important frequency components within the corresponding segmented frequency band. This processing enables prevention of a detection leakage when detecting important ones of frequency components existing within a region where a band mean power value is small. The noise correcting unit 252 operates in the same way as that having been described in FIG. 2B, and thus, description thereof is omitted here.

Figure 2E:
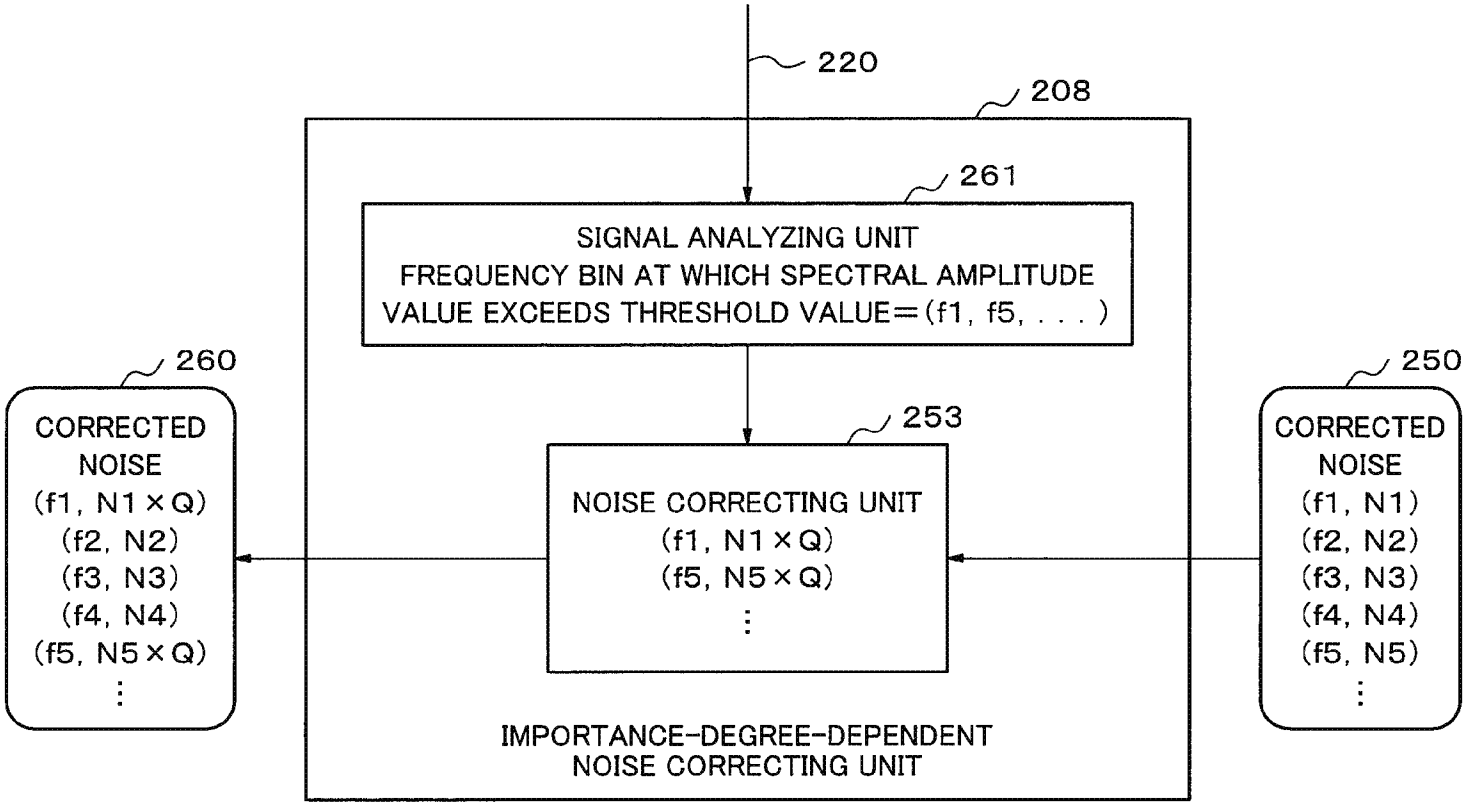
FIG. 2E is a block diagram illustrating an example of a configuration of an importance-degree-dependent noise correcting unit according to a second exemplary embodiment of the present invention.

FIG. 2E illustrates the importance-degree-dependent noise correcting unit 208 resulting from combining the signal analyzing unit 261 shown in FIG. 2D and the noise correcting unit 253 shown in FIG. 2C. Operations thereof are the same as those having been described in FIG. 2C and FIG. 2D, respectively, and thus, description thereof is omitted here.

Figure 2F:
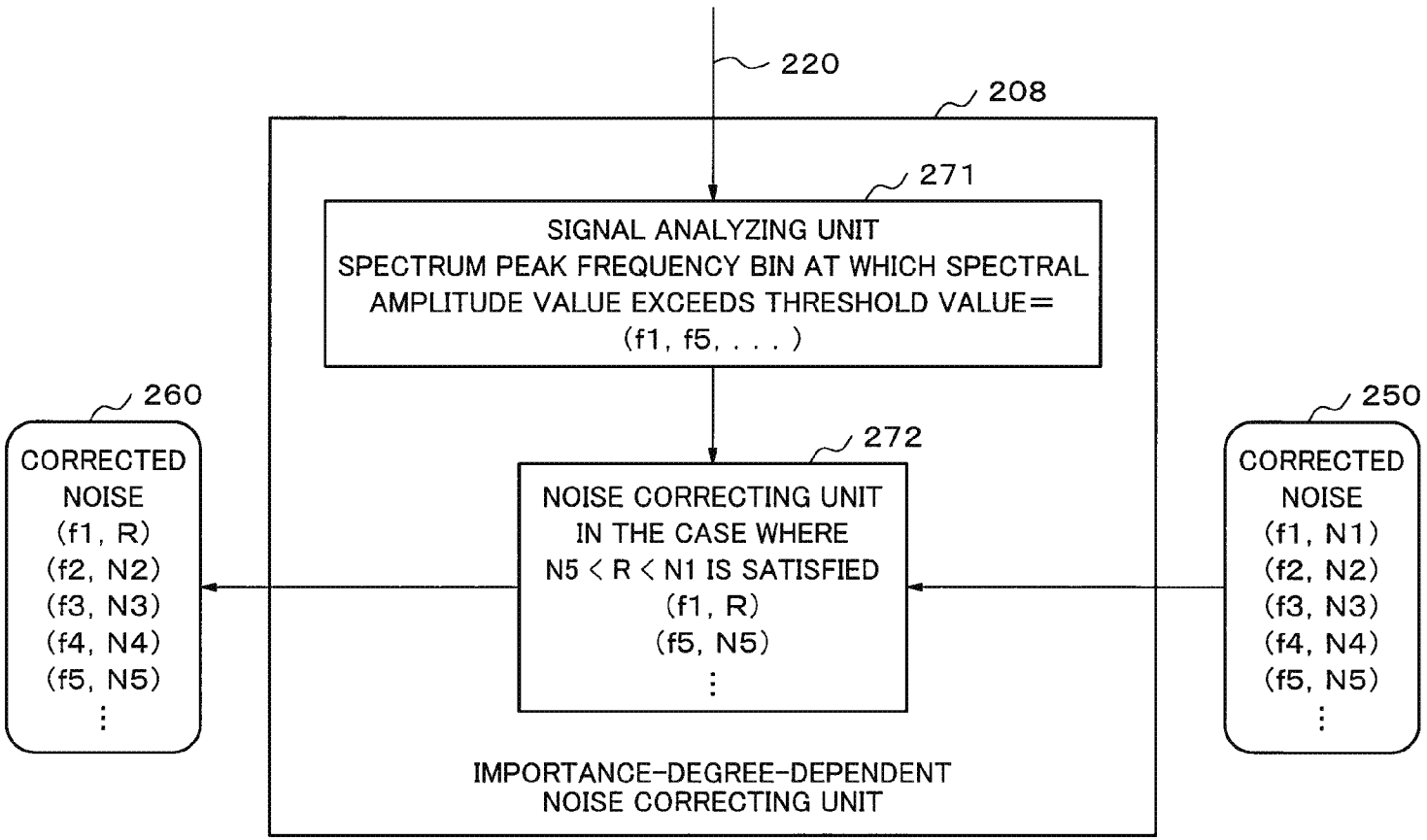
FIG. 2F is a block diagram illustrating an example of a configuration of an importance-degree-dependent noise correcting unit according to a second exemplary embodiment of the present invention.

FIG. 2F is a diagram illustrating a configuration of the importance-degree-dependent noise correcting unit 208 which selects more important spectrum peaks as importance degree information, and performs noise correction thereon. The signal analyzing unit 271 here selects, from among the spectrum peak frequency bins, spectrum peak frequency bins each having an amplitude value exceeding a constant value. Further, the noise analyzing unit 272 performs clipping of noise such that a noise level at each of the selected spectrum peak frequency bins becomes smaller than a constant value. For example, when a noise upper limit value of a spectrum peak frequency bin is denoted by R, the noise analyzing unit 272 outputs R in the case where a level of noise information at a spectrum peak frequency bin is larger than R, and outputs the noise information as it is in the case where the level of the noise information at the spectrum peak frequency bin is smaller than R. As a result, the inputted noise information 250 is corrected into the corrected noise 260 shown in FIG. 2F.

Figure 2G:
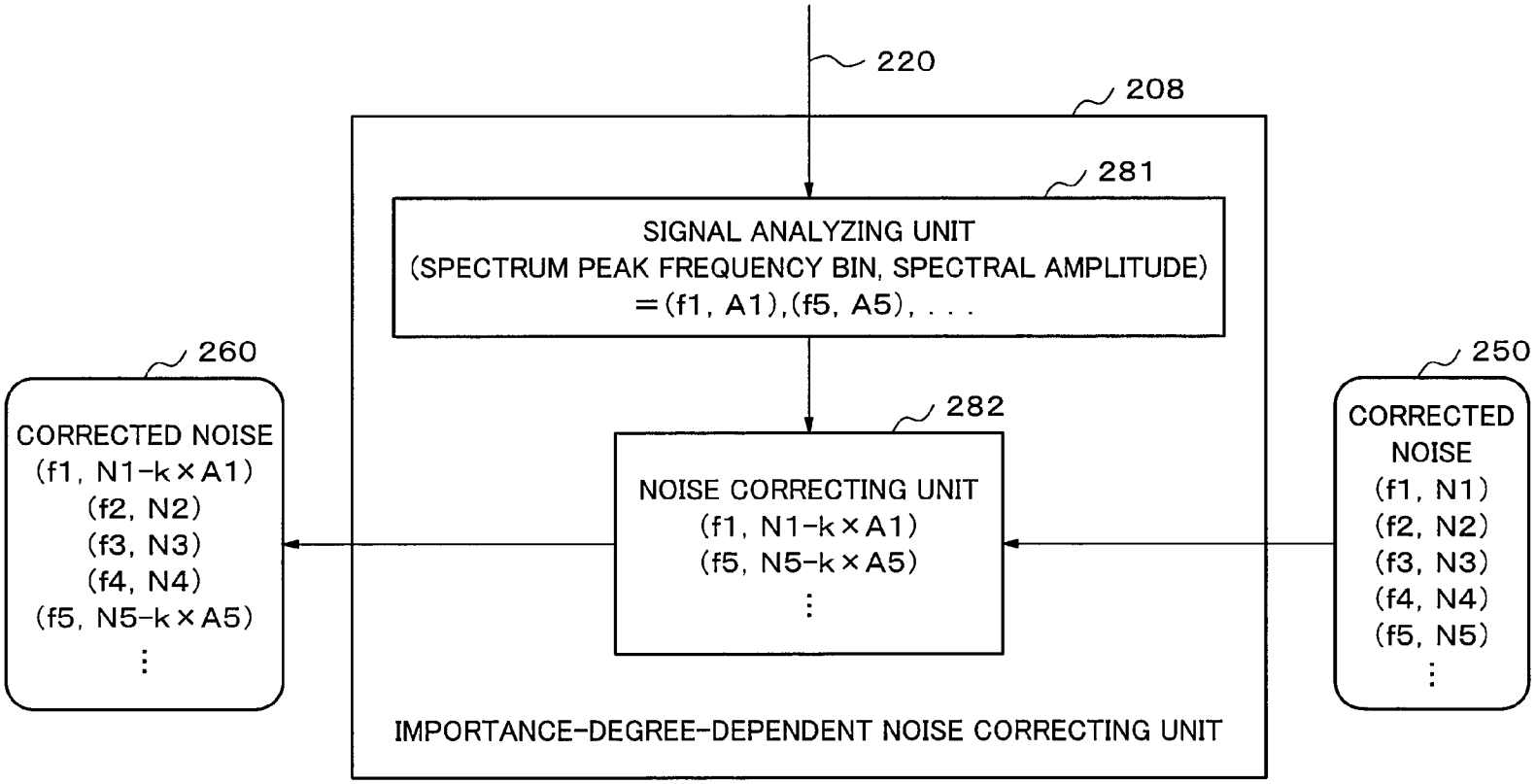
FIG. 2G is a block diagram illustrating an example of a configuration of an importance-degree-dependent noise correcting unit according to a second exemplary embodiment of the present invention.

FIG. 2G is a diagram illustrating a configuration of the importance-degree-dependent noise correcting unit 208 which takes out spectrum peak frequency bins and spectrum peak amplitude values from a noisy speech signal as importance degree information, and corrects noise by using these. The signal analyzing unit 281 supplies the positions (frequency bins) and the magnitudes (amplitude values) of the detected spectrum peaks to a noise correcting unit 282. The noise correcting unit 282 makes estimated noise levels corresponding to the supplied frequency bins small in accordance with the supplied magnitudes of spectrum peaks. As an example, here, the noise correcting unit 282 subtracts values proportional to the respective supplied magnitudes of spectrum peaks (A1, A5, . . . ) from the levels of corresponding pieces of noise information (N1, N2, . . . ). As a result, the inputted noise information 250 is corrected into the corrected noise 260 shown in FIG. 2G.

Besides, the importance-degree-dependent noise correcting unit 208 may analyze likelihood of noise with respect to a noisy speech signal amplitude spectrum. For example, each of spectrum peaks existing in a low frequency band among the detected spectrum peaks has a low likelihood of noise. Further, the likelihood of noise is high at a position where a spectrum value is small and a spectrum peak is not formed. That is, the importance-degree-dependent noise correcting unit 208 may perform correction such that the level of noise information is made small at each of spectrum peak frequency bins existing in a low frequency band.

Importance degree information generated by the importance-degree-dependent noise correcting unit 208 may be information resulting from appropriately combining the above-described spectrum peaks, large spectrum amplitudes and likelihoods of noise. For example, the importance-degree-dependent noise correcting unit 208 may perform control such that, in a frequency band where large spectrum amplitudes are formed, even a small spectrum peak can be detected by making a spectrum peak detecting threshold value small with respect to spectrum components each having a large spectrum amplitude. The importance-degree-dependent noise correcting unit 208 can obtain more accurate importance degree information by using combined indexes. Further, as having been already mentioned in description of a different component, the importance-degree-dependent noise correcting unit 208 can apply sub-band processing or the like in which processing is limited to specific frequency bands.

According to correction processing performed by the importance-degree-dependent noise correcting unit 208, a weak noise suppression is performed in the case where an importance degree is high; while a strong noise suppression is performed in the case where an importance degree is low. As a result, the spectral amplitudes at important frequency bins are maintained, whereby a sound quality of an emphasized signal is significantly improved. In other words, an output with higher quality can be obtained by performing a suppression coupled with an importance degree of a signal on an amplitude or power spectrum of noise.

<Configuration of Transform Unit>

Figure 3:
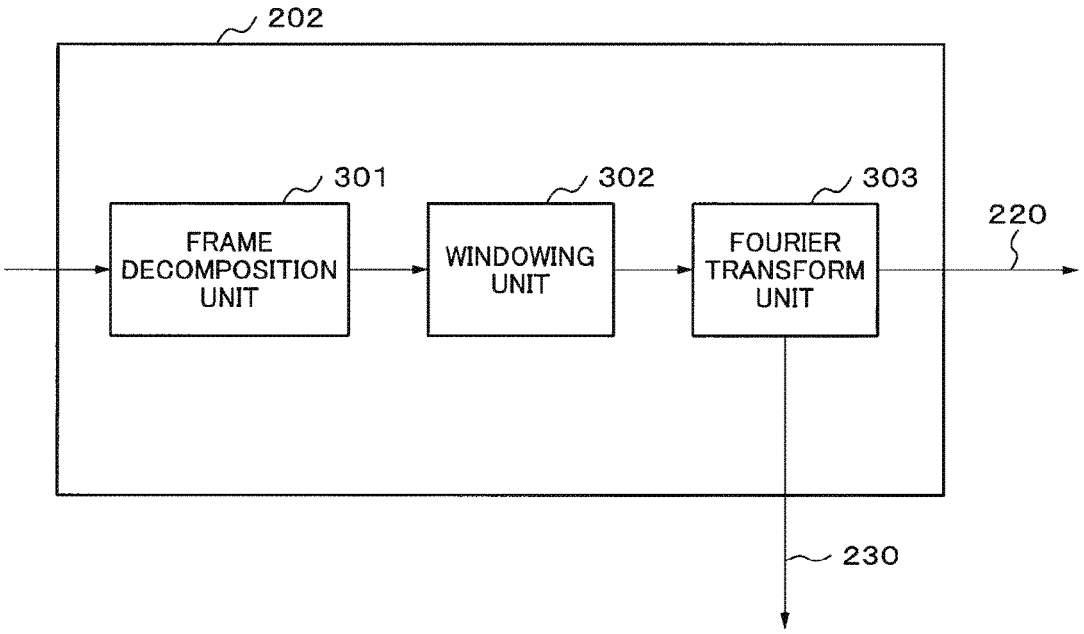
FIG. 3 is a block diagram illustrating a configuration of a transform unit according to a second exemplary embodiment of the present invention.

FIG. 3 is a block diagram illustrating a configuration of the transform unit 202. As shown in FIG. 3, the transform unit 202 includes a frame decomposition unit 301, a windowing unit 302 and a Fourier transform unit 303. Noisy speech signal samples are supplied to the frame decomposition unit 301, and there, are segmented into frames each having K/2 samples. Here, K is an even number. The noisy speech signal samples having been segmented into frames are supplied to the windowing unit 302, and there, are multiplied by w (t), which is a window function. A signal resulting from windowing on an n-th frame input signal yn (t) (t=0, 1, . . . , K/2−1) with w (t) is given by the following equation (1):

$$\bar{y}_n(t)=w(t)y_n(t) \tag{1}$$

Further, the windowing unit 302 may cause every two successive frames to be partially overlapped with each other and then be windowed. Assuming that 50% of a frame length is an overlap length, the left-hand side portion of the following equation (2) represents the output of the windowing unit 302 at t=0, 1, . . . , K/2−1.

$$\left.\begin{aligned}\bar{y}_n(t) &= w(t)y_{n-1}(t+K/2)\\ \bar{y}_n(t+K/2) &= w(t+K/2)y_n(t)\end{aligned}\right\} \tag{2}$$

With respect to a real number signal, the windowing unit 302 may use a symmetrical window function. Further, the window function is designed such that an input signal and an output signal at the time when a spectral gain has been set to 1 in an MMSE STSA method, or at the time when zero has been subtracted in an SS method, correspond to each other except for a computation error. This means that a equation: w(t)+w(t+K/2)=1 is satisfied.

Hereinafter, description will be continued by way of an example in which windowing is performed such that every two successive frames are overlapped with each other under the condition that an overlap length is 50% of a frame length. For example, the windowing unit 402 may use, as w (t), a Hanning window which is represented by the following equation (3).

$$w(t)=\begin{cases}0.5+0.5\cos\left(\dfrac{\pi(t-K/2)}{K/2}\right), & 0\le t<K\\ 0, & \text{otherwise}\end{cases} \tag{3}$$

Besides, various window functions, such as a Hamming window, a Kaiser window and a Blackman window, are also well known. An output obtained by performing the windowing is supplied to the Fourier transform unit 303, and there, is transformed into a noisy speech signal spectrum Yn (k). The noisy speech signal spectrum Yn (k) is separated into a phase and an amplitude, so that a noisy speech signal phase spectrum arg Yn (k) is supplied to the inverse transform unit 203 and a noisy speech signal amplitude spectrum |Yn (k)| is supplied to the noise estimating unit 206. As already described, a power spectrum may be used as a substitute for the amplitude spectrum.

<Configuration of Inverse Transform Unit>

Figure 4:
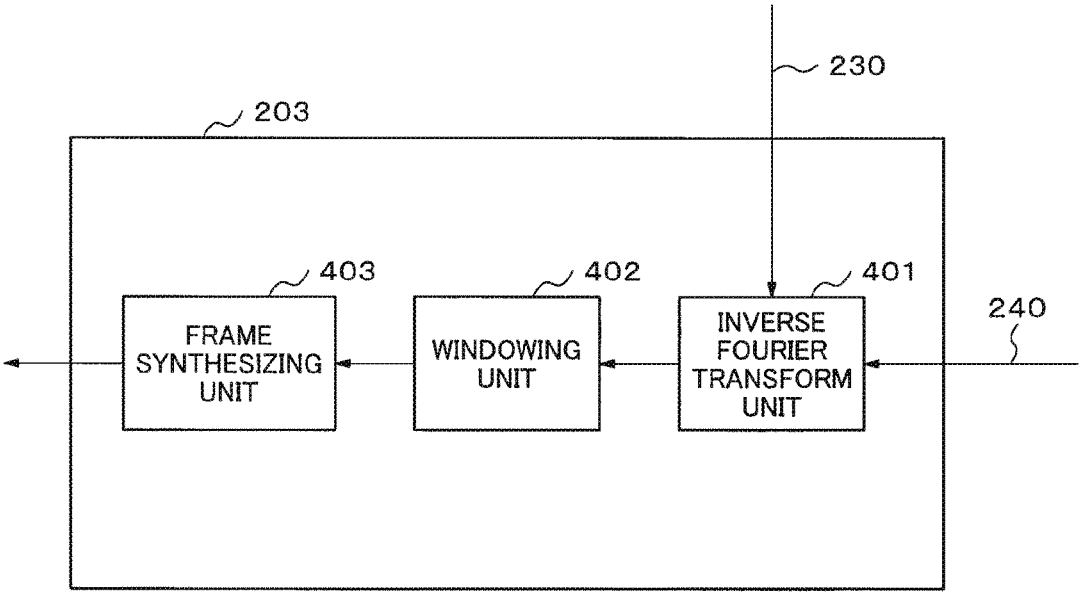
FIG. 4 is a block diagram illustrating a configuration of an inverse transform unit according to a second exemplary embodiment of the present invention.

FIG. 4 is a block diagram illustrating a configuration of the inverse transform unit 203. As shown in FIG. 4, the inverse transform unit 203 includes an inverse Fourier transform unit 401, a windowing unit 402 and a frame synthesizing unit 403. The inverse Fourier transform unit 401 multiplies the emphasized signal amplitude spectrum 240, which is supplied from the noise suppressing unit 205, by the noisy speech signal phase spectrum 230 supplied from the transform unit 202, and thereby obtains an emphasized signal (the left-hand side portion of the following equation (4)).

$$\bar{X}_n(k)=|\bar{X}_n(k)|\cdot\arg Y_n(k) \tag{4}$$

The inverse Fourier transform unit 401 performs an inverse Fourier transform on the obtained emphasized signal, and supplies the windowing unit 402 with a resultant signal, which is a sequence of time-domain sample values: xn (t) (t=0, 1, . . . , K−1), including K samples per one frame. The windowing unit 402 multiplies xn (t) by a window function w (t). A signal obtained by performing windowing on an n-th frame input signal xn (t) (t=0, 1, . . . , K/2−1) with w(t) is given by the left-hand side portion of the following equation (5).

$$\bar{x}_n(t)=w(t)x_n(t) \tag{5}$$

Further, it is also widely carried out that every two successive frames are partially overlapped with each other and then are windowed. Assuming that 50% of a frame length is an overlap length, the left-hand side portions of the following equations (6) correspond to an output of the windowing unit 402 at t=0, 1, . . . , K/2−1, which is transmitted to the frame synthesizing unit 403.

$$\left.\begin{aligned}\bar{x}_n(t) &= w(t)x_{n-1}(t+K/2)\\ \bar{x}_n(t+K/2) &= w(t+K/2)x_n(t)\end{aligned}\right\} \tag{6}$$

The frame synthesizing unit 403 takes out two sets of K/2 samples from respective two adjacent frames of the output frames of the windowing unit 402, and overlaps the two sets of K/2 samples, so that an output signal at t=0, 1, . . . , K−1 is obtained as shown in the left-hand side portion of the following equation (7). The obtained output signal is transmitted to the output terminal 204 from the frame synthesizing unit 403.

$$\hat{x}_n(t)=\bar{x}_{n-1}(t+K/2)+\bar{x}_n(t) \tag{7}$$

In addition, in FIGS. 3 and 4, transformation performed in each of the transform unit 202 and the inverse transform unit 203 was described as the Fourier transform, but different transformation, such as a cosine transform, a corrected cosine transform, Hadamard transform, Haar transform, wavelet transform, may be used as a substitute instead of the Fourier transform. For example, the cosine transform and the corrected cosine transform each output only spectral amplitudes as the transformation result. Thus, in FIG. 2, a path from the transform unit 202 to the inverse transform unit 203 becomes unnecessary. Further, noise information to be recorded in a noise storing unit is also only noise information related to a spectrum amplitude (or power), and this contributes to a reduction of a storage capacity, as well as a reduction of an amount of arithmetic operation in the noise suppression processing. In the case where each of the transform unit 202 and the inverse transform unit 203 uses the Haar transform, the multiplication becomes unnecessary. In the case where each of the transform unit 202 and the inverse transform unit 203 uses the wavelet transform, since time resolutions can be changed to mutually different ones for respective frequency bins, it is possible to expect a further increase of a noise suppression effect.

<Configuration of Noise Estimating Unit>

Figure 5:
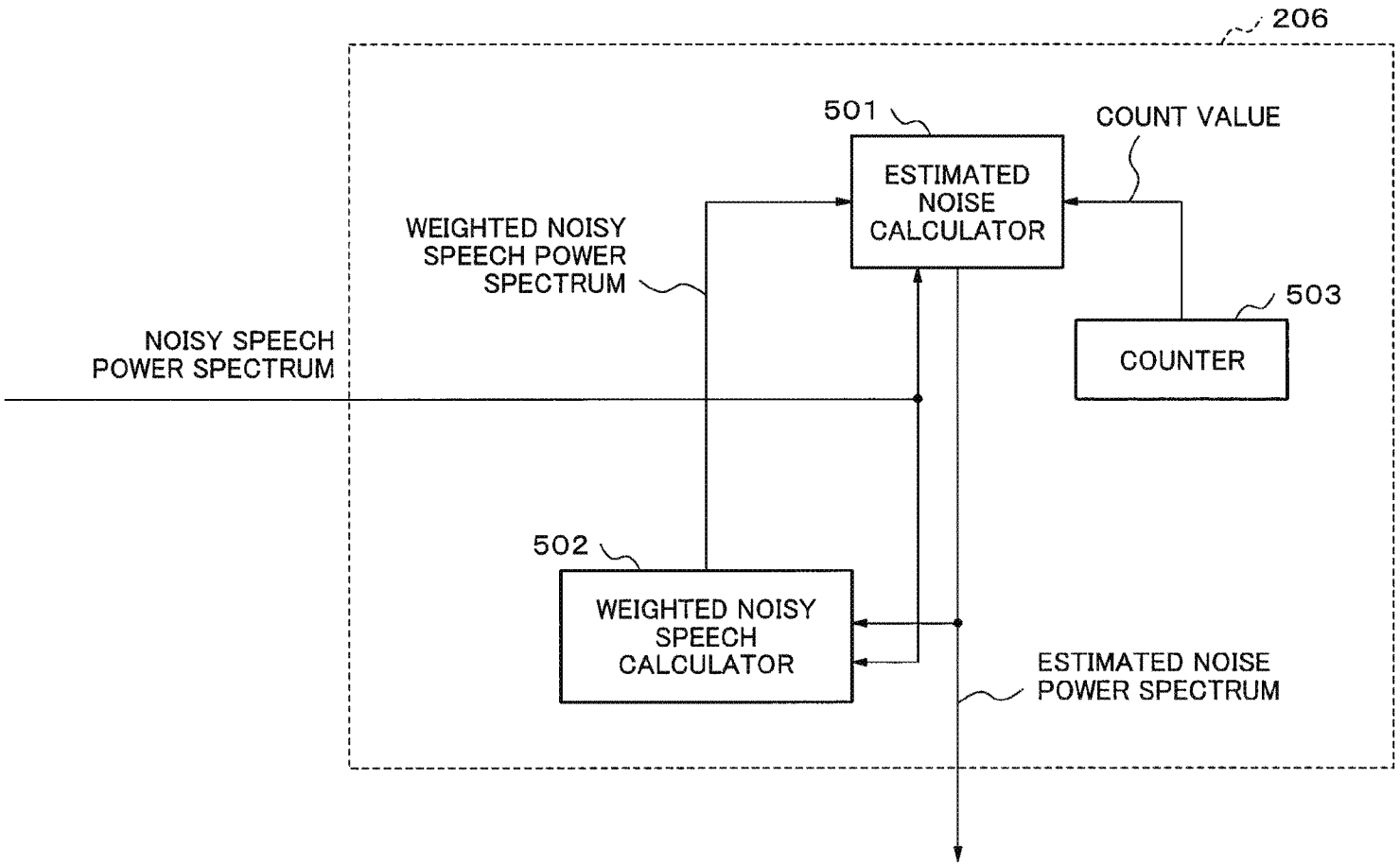
FIG. 5 is a block diagram illustrating a configuration of a noise estimating unit according to a second exemplary embodiment of the present invention.

FIG. 5 is a block diagram illustrating a configuration of the noise estimating unit 206 of FIG. 2A. The noise estimating unit 206 includes an estimated noise calculator 501, a weighted noisy speech calculator 502 and a counter 503. A noisy speech power spectrum supplied to the noise estimating unit 206 is transmitted to the estimated noise calculator 501 and the weighted noisy speech calculator 502. The weighted noisy speech calculator 502 calculates a weighted noisy speech power spectrum by using the supplied noisy speech power spectrum and an estimated noise power spectrum, and transmits the calculated weighted noisy speech power spectrum to the estimated noise calculator 501. The estimated noise calculator 501 estimates a power spectrum of noise by using the noisy speech power spectrum, the weighted noisy speech power spectrum and a count value supplied from the counter 503, outputs the resultant power spectrum of noise as the estimated noise power spectrum, and further, feeds back it to the weighted noisy speech calculator 502.

Figure 6:
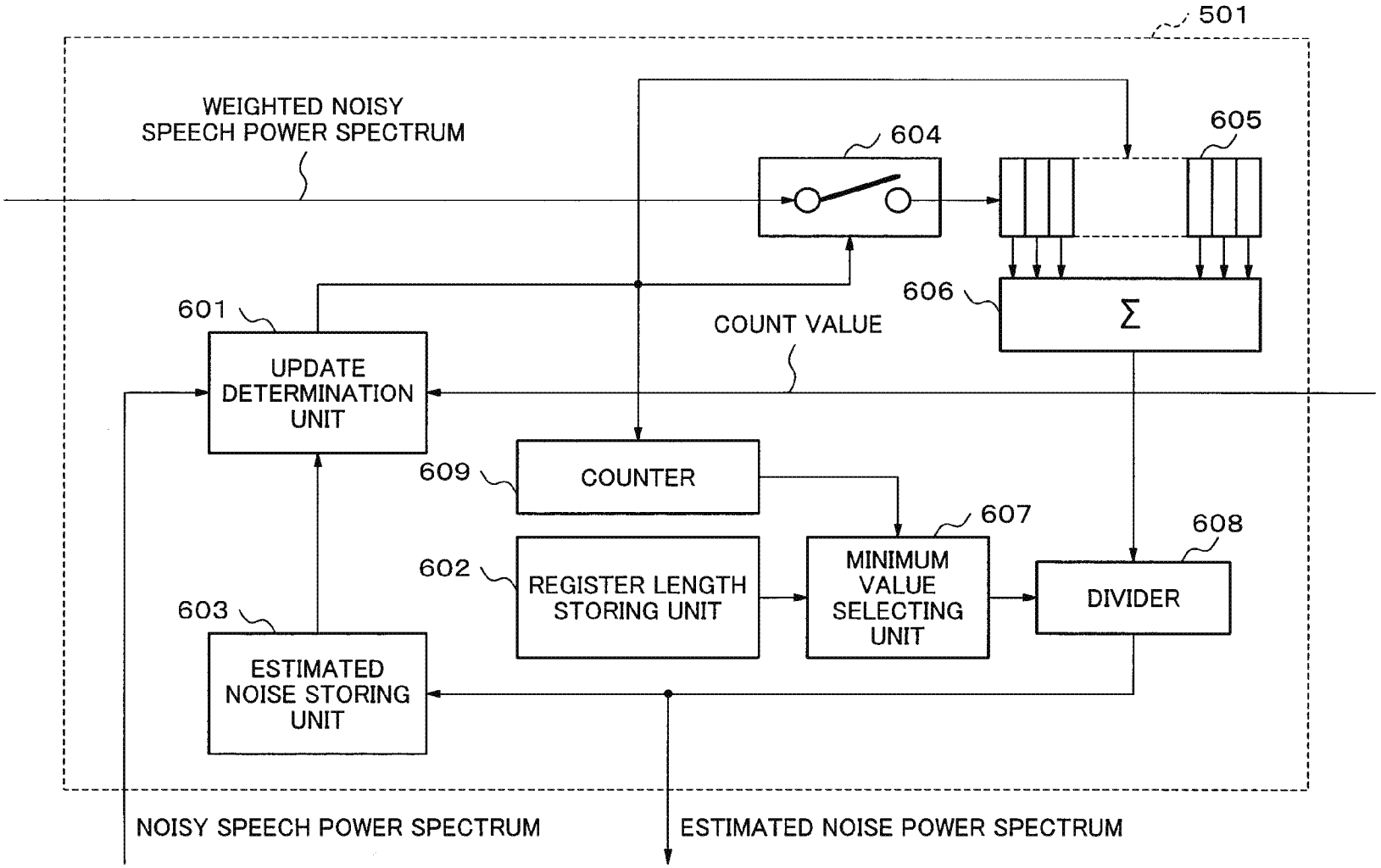
FIG. 6 is a block diagram illustrating a configuration of a noise estimation calculator according to a second exemplary embodiment of the present invention.

FIG. 6 is a block diagram illustrating a configuration of the estimated noise calculator 501 included in FIG. 5. The estimated noise calculator 501 has an update determination unit 601, a register length storing unit 602, an estimated noise storing unit 603, a switch 604, a shift register 605, an adder 606, a minimum value selecting unit 607, a divider 608 and a counter 609. The switch 604 is supplied with the weighted noisy speech power spectrum. When the switch 604 closes its circuit, the weighted noisy speech power spectrum is transmitted to the shift register 605. The shift register 605 shifts a storage value of its each internal register to an adjacent internal register in response to a control signal supplied from the update determination unit 601. A shift register length is equal to a value which is stored in the register length storing unit 602 described below. All register outputs of the shift register 605 are supplied to the adder 606. The adder 606 performs addition of the supplied all register outputs, and transmits an addition result to the divider 608.

Meanwhile, the update determination unit 601 is supplied with a count value, a frequency-dependent noisy speech power spectrum and a frequency-dependent estimated noise power spectrum. The update determination unit 601 constantly outputs a value signal "1" before the count value reaches a preset value. After the count value has reached the preset value, in the case where an inputted noisy speech signal is determined as noise, the update determination unit 601 outputs a value signal "1"; otherwise, the update determination unit 601 outputs a value signal "0". Further, the update determination unit 601 transmits the outputted value signal to the counter 609, the switch 604 and the shift register 605. The switch 604 closes its circuit when a value signal supplied from the update determination unit 601 is "1", and opens its circuit when the value signal supplied therefrom is "0". The counter 609 increments its count value when a value signal supplied from the update determination unit 601 is "1", and does not change its count value when the value signal supplied therefrom is "0". When a value signal supplied from the update determination unit 601 is "1", the shift register 605 takes in one signal sample supplied from the switch 604, and at the same time, shifts a storage value of each of its internal registers to an internal register adjacent thereto. The minimum value selecting unit 607 is supplied with the output of the counter 609 and the output of the register length storing unit 602.

The minimum value selecting unit 607 selects a smaller one of the supplied count value and register length, and transmits the selected count value or register length to the divider 608. The divider 608 performs division of the addition result value of the noisy speech power spectrum, having been supplied from the adder 606, by the smaller one of the count value and the register length, and outputs its quotient as a frequency-dependent estimated noise power spectrum λn (k). Supposing that Bn (k) (n=0, 1, . . . , N−1) corresponds to respective sample values of the noisy speech power spectrum stored in the shift register 605, λn (k) is given by the following equation (8):

$$\lambda_n(k) = \frac{1}{N}\sum_{n=0}^{N-1} B_n(k) \tag{8}$$

In addition, N is a value of a smaller one of the count value and the register length. Since the count value starts from zero and increments monotonously, the divider 608 initially performs division of the addition result value by the count value, and then performs division thereof by the register length. Performing the division by the register length results in calculation of a mean value of the values stored in the shift register. Initially, since sufficient many values are not yet stored in the shift register 605, the division is performed by the number of register elements in which corresponding values are actually stored. The number of register elements in which corresponding values are actually stored is equal to the count value when the count value is smaller than the register length, and is equal to the register length when the count value becomes larger than the register length.

Figure 7:
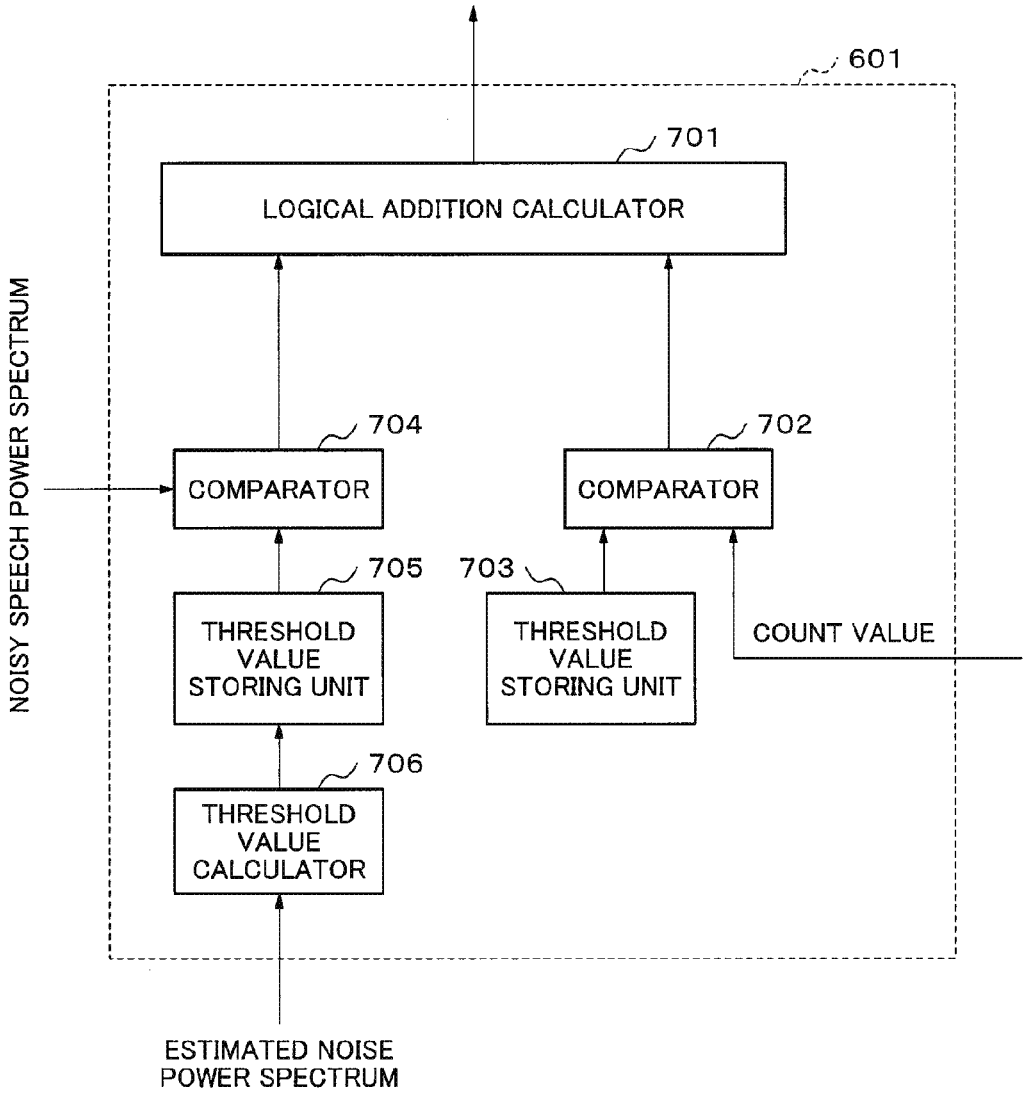
FIG. 7 is a block diagram illustrating a configuration of an update determination unit according to a second exemplary embodiment of the present invention.

FIG. 7 is a block diagram illustrating a configuration of the update determination unit 601 included in FIG. 6. The update determination unit 601 has a logical addition calculator 701, comparators 702 and 704, threshold value storing units 705 and 703 and a threshold value calculator 706. The count value supplied from the counter 503 shown in FIG. 5 is transmitted to the comparator 702. A threshold value, which is the output of the threshold value storing unit 703, is also transmitted to the comparator 702. The comparator 702 compares the supplied count value and threshold value, so that the comparator 702 transmits "1" to the logical addition calculator 701 in the case where the count value is smaller than the threshold value, and transmits "0" thereto in the case where the count value is larger than the threshold value. Meanwhile, the threshold value calculator 706 calculates a value in accordance with the estimated noise power spectrum supplied from the estimated noise storing unit 603 shown in FIG. 6, and outputs the calculated value to the threshold value storing unit 705 as a threshold value. The easiest method of calculating the threshold value is multiplying the estimated noise power spectrum by a constant number.

Besides, the threshold value calculator 706 may calculate the threshold value by using a high order polynomial expression or a nonlinear function. The threshold value storing unit 705 stores therein a threshold value outputted from the threshold value calculator 706, and outputs a threshold value having been stored at a time before one frame to the comparator 704. The comparator 704 compares the threshold value supplied from the threshold value storing unit 705 and the magnitude of the noisy speech power spectrum supplied from the transform unit 202, so that the comparator 704 outputs "1" to the logical addition calculator 701 when the magnitude of the noisy speech power spectrum is smaller than the threshold value, and outputs "0" thereto when the magnitude of the noisy speech power spectrum is larger than the threshold value. That is, the comparator 704 determines whether the noisy speech signal is noise, or not, on the basis of the magnitude of the estimated noise power spectrum. The logical addition calculator 701 calculates a logical sum of the output value of the comparator 702 and the output value of the comparator 704, and outputs the calculation result to the switch 604, the shift register 605 and the counter 609 which are shown in FIG. 6. In this way, the update determination unit 601 outputs "1" not only during an initial state and a silent period, but also when the magnitude of the noisy speech power is small even during a non-silent period. That is, the update of estimated noise is performed. Since the threshold value is calculated for each frequency bin, it is possible to update the estimated noise for each frequency bin.

Figure 8:
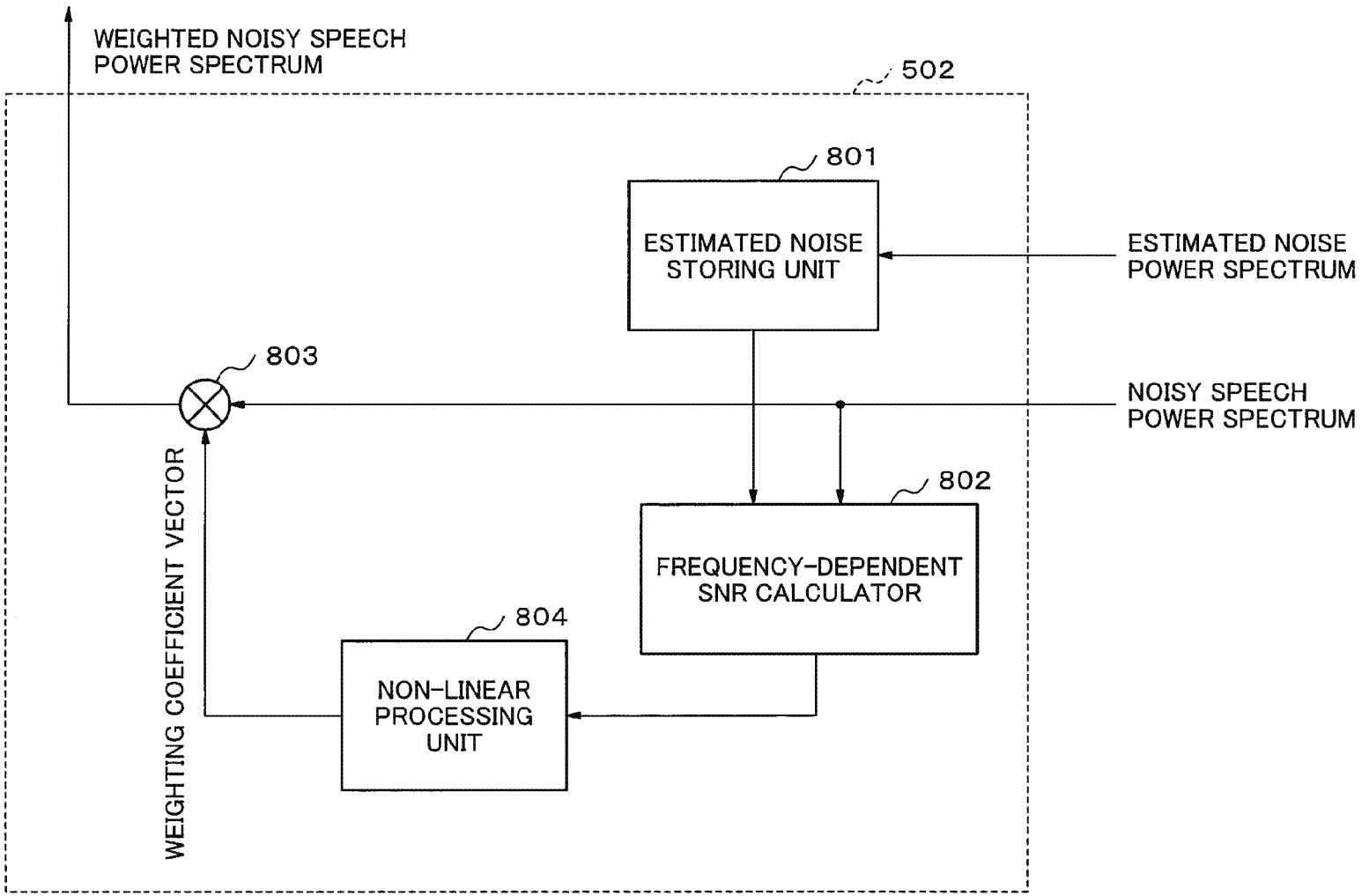
FIG. 8 is a block diagram illustrating a configuration of a weighted noisy speech calculator according to a second exemplary embodiment of the present invention.

FIG. 8 is a block diagram illustrating a configuration of the weighted noisy speech calculator 502. The weighted noisy speech calculator 502 has an estimated noise storing unit 801, a frequency-dependent SNR calculator 802, a non-linear processing unit 804 and a multiplier 803. The estimated noise storing unit 801 stores therein an estimated noise power spectrum supplied from the estimated noise calculator 501 shown in FIG. 5, and outputs the estimated noise power spectrum having been stored at a time before one frame to the frequency-dependent SNR calculator 802. The frequency-dependent SNR calculator 802 calculates a signal-noise ratio (SNR) for each frequency band by using the estimated noise power spectrum supplied from the estimated noise storing unit 801 and the noisy speech power spectrum supplied from the transform unit 202, and outputs the calculated SNR to the non-linear processing unit 804. Specifically, the frequency-dependent SNR calculator 802 calculates a frequency-dependent SNR γn (k) hat by performing division of the supplied noisy speech power spectrum by the supplied estimated noise power spectrum according to the following equation (9). Here, λn−1 (k) is an estimated noise power spectrum having been stored at a time before one frame.

$$\hat{\gamma}_n(k) = \frac{|Y_n(k)|^2}{\lambda_{n-1}(k)} \tag{9}$$

The non-linear processing unit 804 calculates a weighting coefficient vector by using an SNR supplied from the frequency-dependent SNR calculator 802, and outputs the calculated weighting coefficient vector to the multiplier 803. The multiplier 803 calculates, for each frequency band, a product of the noisy speech power spectrum supplied from the transform unit 202 and the weighting coefficient vector supplied from the non-linear processing unit 804, and outputs a weighted noisy speech power spectrum to the estimated noise calculator 501 shown in FIG. 5.

Figure 9:
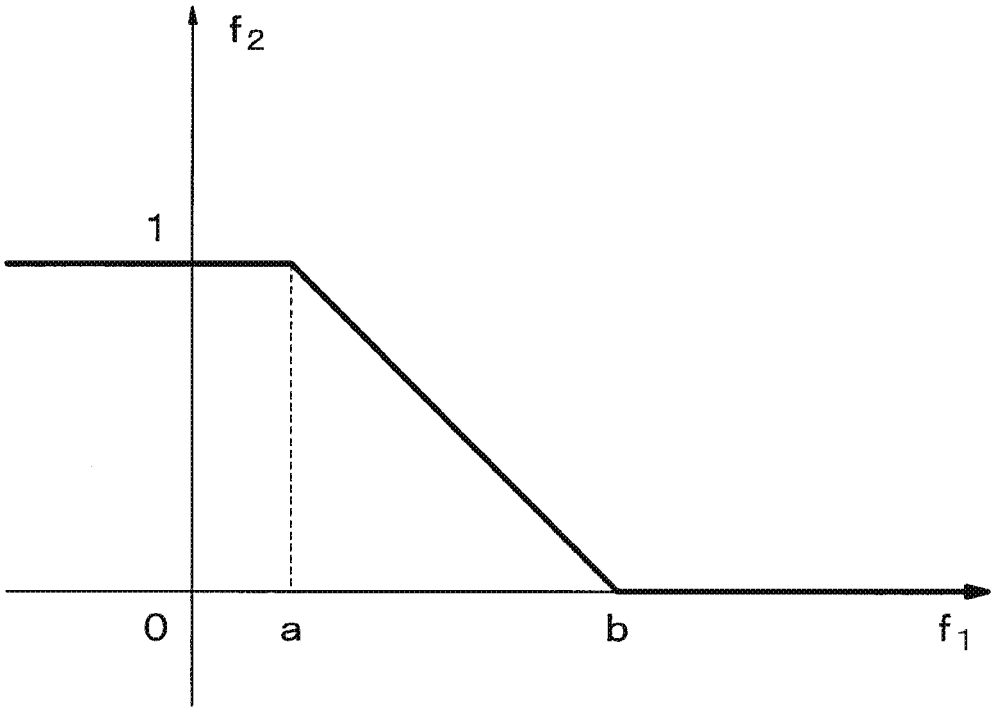
FIG. 9 is a diagram illustrating an example of a nonlinear function according to a second exemplary embodiment of the present invention.

The non-linear processing unit 804 has a nonlinear function which outputs real number values in accordance with respective multiplexed input values. In FIG. 9, an example of the nonlinear function is illustrated. When supposing f1 as an input value, an output value f2 of the nonlinear function shown in the FIG. 9 is represented by the following equation (10). In addition, a and b are predetermined real numbers, respectively.

$$f_2 = \begin{cases} 1, & f_1 \le a \\ \dfrac{f_1 - b}{a - b}, & a < f_1 \le b \\ 0, & b < f_1 \end{cases} \tag{10}$$

The non-linear processing unit 804 obtains a weighting coefficient by processing a frequency-band dependent SNR supplied from the frequency-dependent SNR calculator 802 by using the nonlinear function, and transmits the weighting coefficient to the multiplier 803. That is, the non-linear processing unit 804 outputs a weighting coefficient which takes a value from "1" to "0" depending on the SNR. The non-linear processing unit 804 outputs "1" when the SNR is smaller than or equal to a, and outputs "0" when the SNR is larger than b.

The weighting coefficient, by which the noisy speech power spectrum is multiplied in the multiplier 803 shown in FIG. 8, is a value depending on the SNR, and the larger the SNR becomes, that is, the larger the amount of speech component included in the noisy speech becomes, the smaller the value of the weighting coefficient becomes. In general, the noisy speech power spectrum is used for the update of the estimated noise. In this exemplary embodiment, however, the multiplier 803 performs weighting depending on the SNR with respect to the noisy speech power spectrum used for the update of the estimated noise. In this way, the noise suppression device 200 can make the influence of the speech component included in the noisy speech power spectrum smaller, thereby enabling more accurate estimation of noise. In addition, there has been shown an example above in which the multiplier 803 uses a nonlinear function when calculating the weighting coefficient, but the multiplier 803 may use a function other than the nonlinear function, which represents the SNR in a different form, such as a linear function or a high order polynomial expression.

In such a way as described above, according to the configuration of this exemplary embodiment, it is possible to realize signal processing with high quality by leaving important signal components as they are.

Third Exemplary Embodiment

Figure 10:
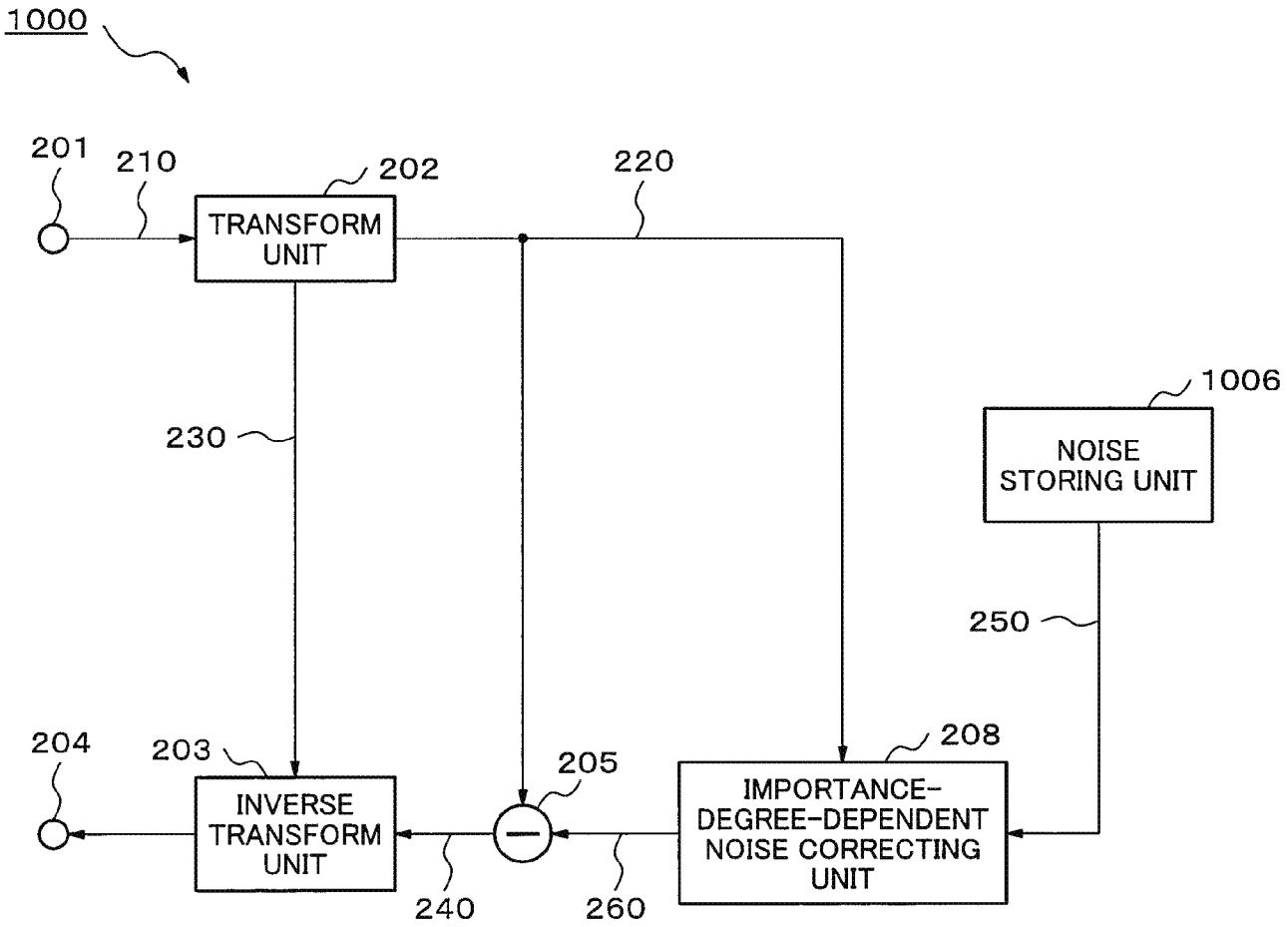
FIG. 10 is a block diagram illustrating a configuration of a noise suppression device according to a third exemplary embodiment of the present invention.

FIG. 10 is a block diagram illustrating a schematic configuration of a noise suppression device 1000 as a third exemplary embodiment of the present invention. The noise suppression device 1000 according to this exemplary embodiment is configured to, unlike in the case of the second exemplary embodiment, include a noise storing unit 1006 as an substitute for the noise estimating unit 206.

The noise storing unit 1006 includes a memory element, such as a semiconductor memory, and stores therein noise information (information related to the characteristics of noise). The noise storing unit 1006 stores therein the shape of a noise spectrum as noise information. The noise storing unit 1106 may store therein feature amounts, such as a frequency characteristic of phase, strengths in specific frequencies and a temporal variation, in addition to the spectrum. Besides, the noise information may be any one or more of statistics (a maximum, a minimum, a variance and a median) or the like. In the case where a spectrum is represented by 1024 frequency components, 1024 pieces of data related to a spectral amplitude (or power) are stored in the noise storing unit 1106. The noise information 250 recorded in the noise storing unit 1006 is supplied to the importance-degree-dependent noise correcting unit 208.

Since other components and operations thereof are the same as those of the second exemplary embodiment, the same components as those of the second exemplary embodiment are denoted by the same corresponding reference signs as those thereof, and detailed description thereof is omitted here.

According to this exemplary embodiment, just like in the case of the second exemplary embodiment, it is also possible to realize signal processing with high quality by leaving important signal components as they are.

Fourth Exemplary Embodiment

Figure 11:
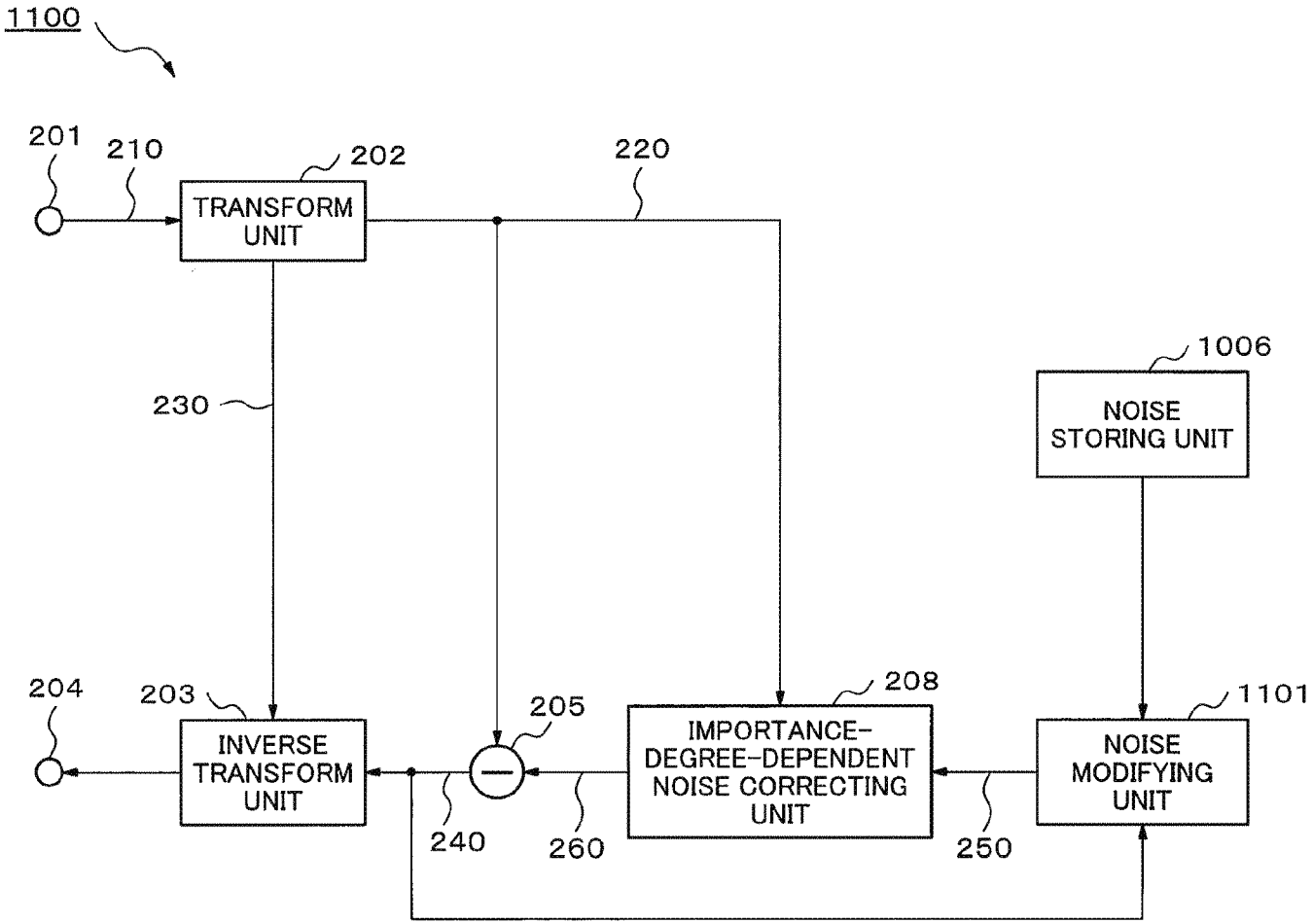
FIG. 11 is a block diagram illustrating a configuration of a noise suppression device according to a fourth exemplary embodiment of the present invention.

FIG. 11 is a block diagram illustrating a schematic configuration of a noise suppression device 1100 as a fourth exemplary embodiment of the present invention. The noise suppression device 1100 is configured to, unlike in the case of the third exemplary embodiment, to cause a noise modifying unit 1101 to modify the output from the noise storing unit 1006, and then supply modified noise information to the importance-degree-dependent noise correcting unit 208.

The noise modifying unit 1101 receives an output 240 from the noise suppressing unit 205, and modifies noise in accordance with a feedback of the noise suppression result.

Since other components and operations thereof are the same as those of the third exemplary embodiment, the same components as those of the third exemplary embodiment are denoted by the same corresponding reference signs as those thereof, and detailed description thereof is omitted here.

According to this exemplary embodiment, it is also possible to realize signal processing with high quality by leaving important signal components as they are, just like in the case of the third exemplary embodiment, and further, it is possible to perform a more accurate noise suppression.

Fifth Exemplary Embodiment

Figure 14:
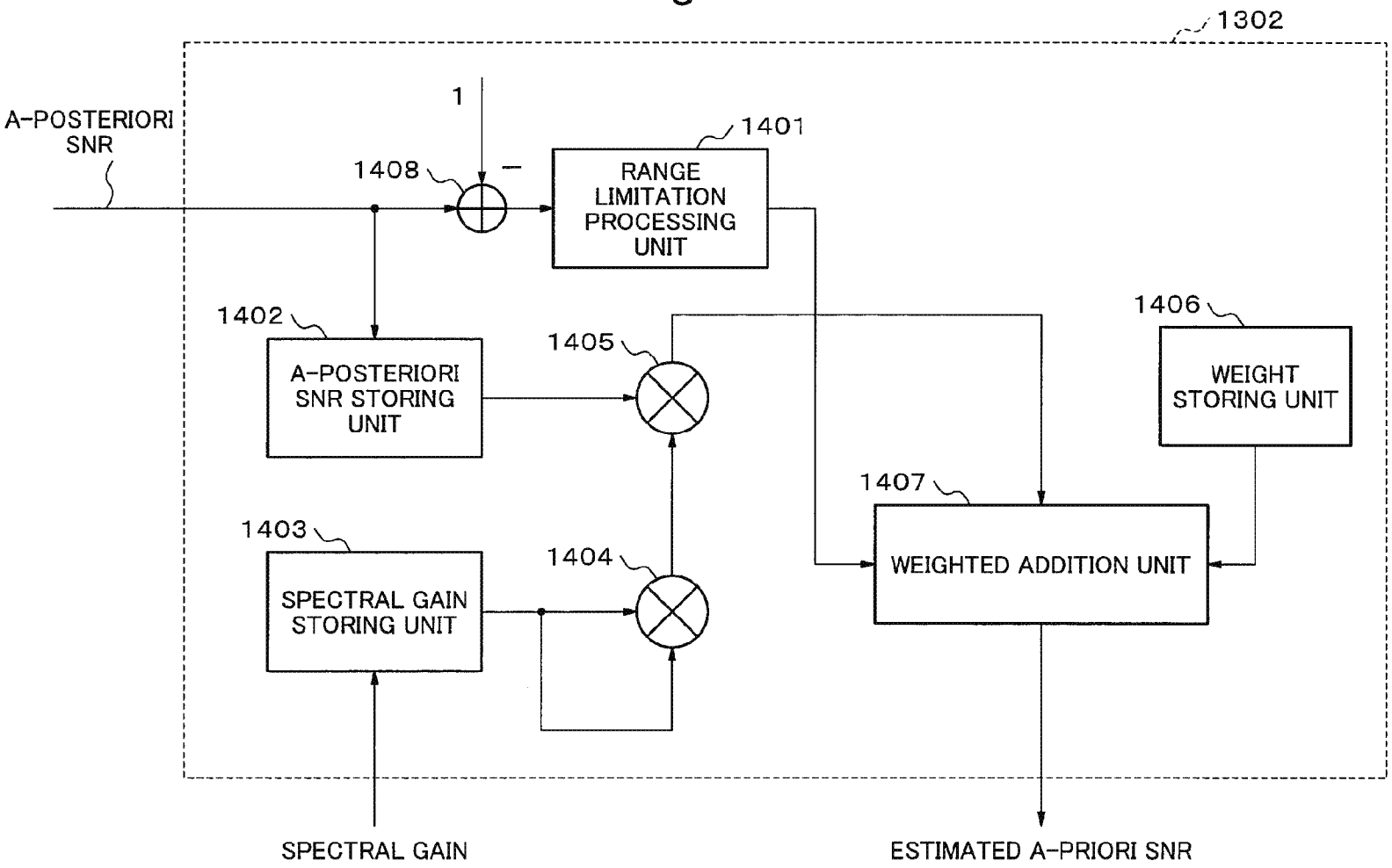
FIG. 14 is a block diagram illustrating a configuration of an estimated a-priori SNR calculator according to a fifth exemplary embodiment of the present invention.

FIG. 14 is a block diagram illustrating a schematic configuration of a noise suppression device 1200 as a fifth exemplary embodiment of the present invention. When comparing FIG. 2A and FIG. 12, the noise suppression device 1200 according to this exemplary embodiment is configured to, unlike in the case of the second exemplary embodiment, include a spectral gain generating unit 1210 which generates spectral gains by using noise information and a noisy speech signal. Moreover, the noise suppression device 1200 according to this exemplary embodiment includes a noise suppressing unit 1205 which performs multiplication. Since other components and operations thereof are the same as those of the second exemplary embodiment, the same components as those of the second exemplary embodiment are denoted by the same corresponding reference signs as those thereof, and detailed description thereof is omitted here.

<Configuration of Spectral Gain Generating Unit>

Figure 12:
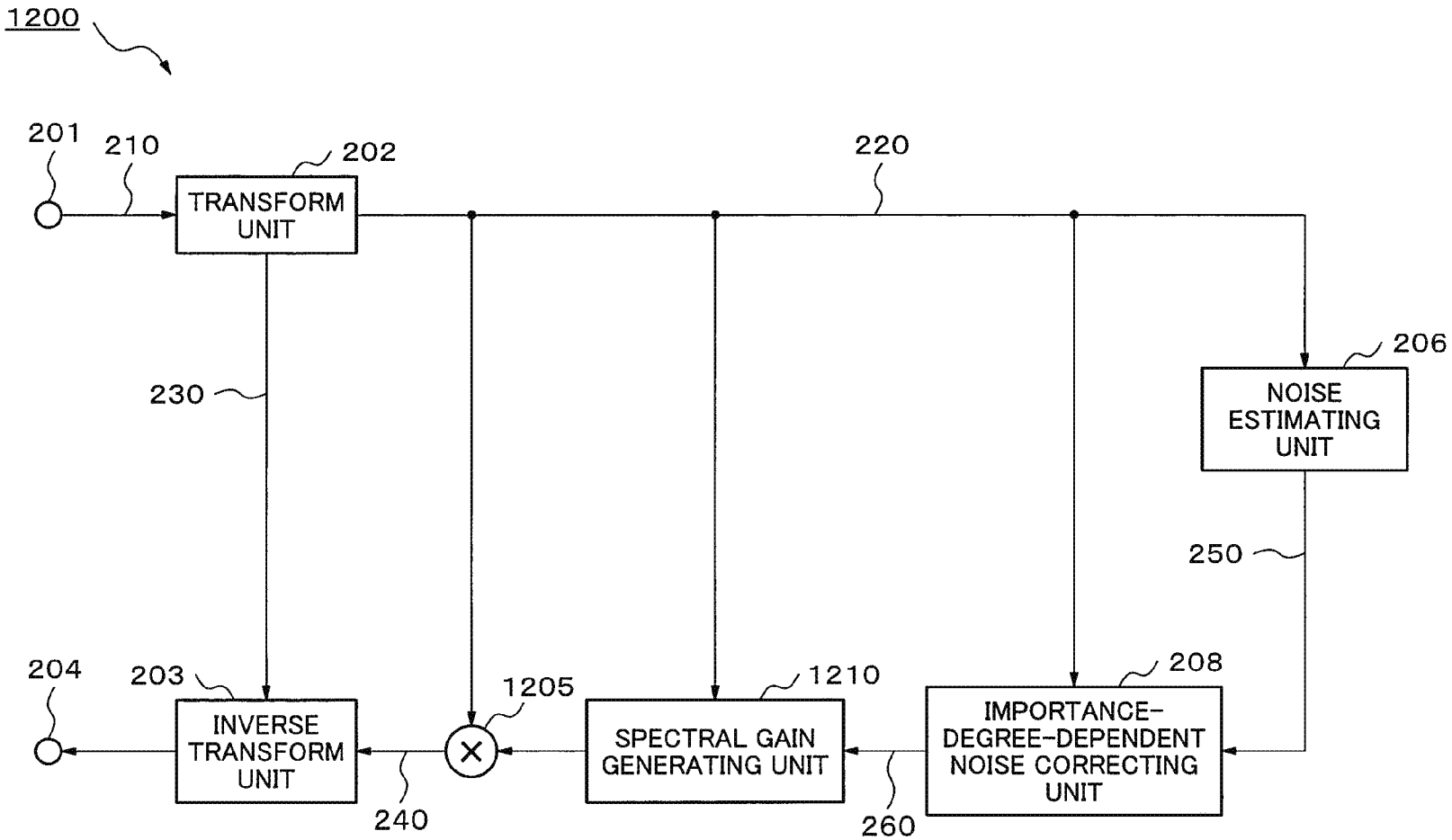
FIG. 12 is a block diagram illustrating a configuration of a noise suppression device according to a fifth exemplary embodiment of the present invention.
Figure 13:
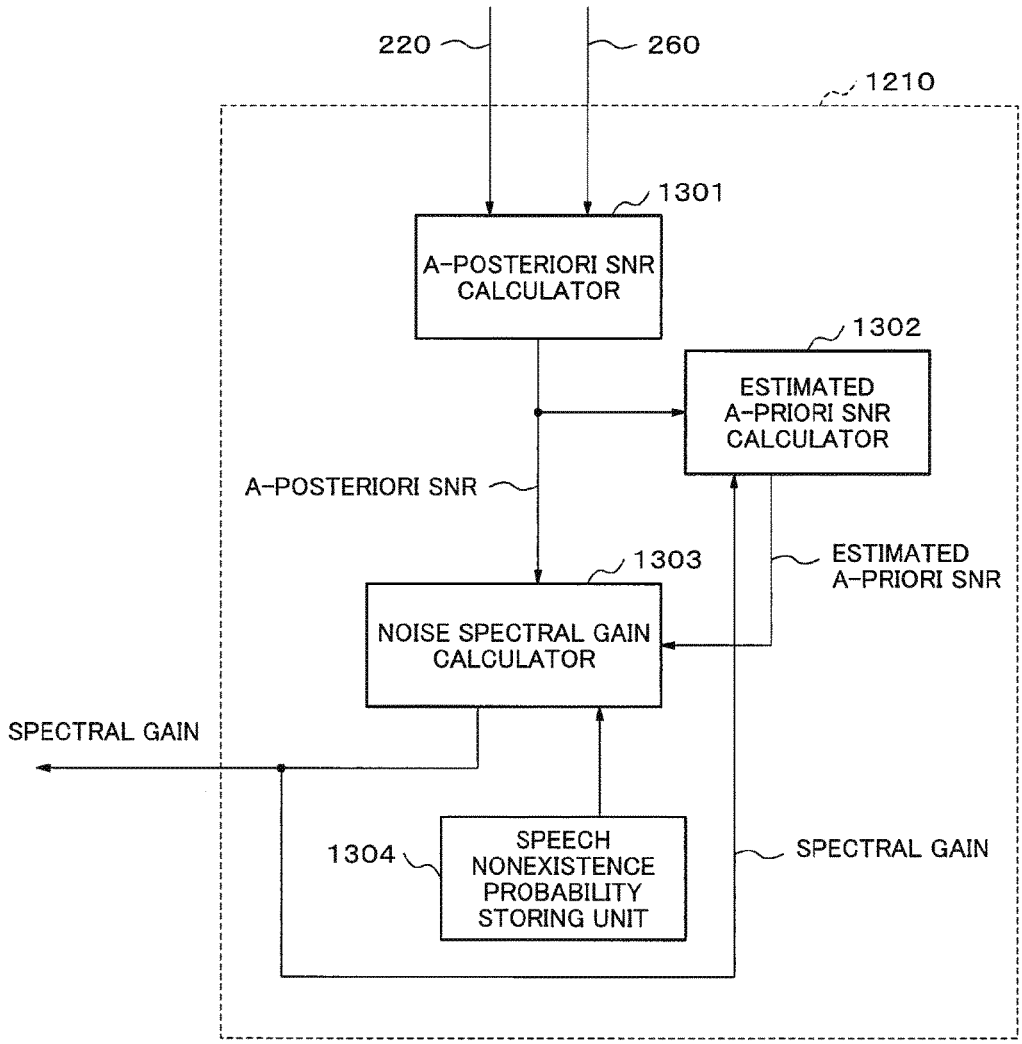
FIG. 13 is a block diagram illustrating a configuration of a spectral gain generating unit according to a fifth exemplary embodiment of the present invention.

FIG. 13 is a block diagram illustrating a configuration of the spectral gain generating unit 1210 included in FIG. 12. As shown in FIG. 13, the spectral gain generating unit 1210 includes an a-posteriori SNR calculator 1301, an estimated a-priori SNR calculator 1302, a noise spectral gain calculator 1303 and a speech nonexistence probability storing unit 1304.

The a-posteriori SNR calculator 1301 calculates, for each frequency bin, an a-posteriori SNR by using an inputted noisy speech power spectrum and an inputted estimated noise power spectrum, and supplies the calculated a-posteriori SNR to the estimated a-priori SNR calculator 1302 and the noise spectral gain calculator 1303. The estimated a-priori SNR calculator 1302 estimates an a-priori SNR by using an inputted posteriori SNR and a spectral gain fed back from the noise spectral gain calculator 1303, and transmits the a-priori SNR to the noise spectral gain calculator 1303 as an estimated a-priori SNR. The noise spectral gain calculator 1303 generates a noise spectral gain by using the a-posteriori SNR and the a-priori SNR, which are supplied as inputs, as well as a speech nonexistence probability supplied from the speech nonexistence probability storing unit 1304, and outputs the generated noise spectral gain as a spectral gain Gn (k) bar.

FIG. 14 is block diagram illustrating a configuration of the estimated a-priori SNR calculator 1302 included in FIG. 13. The estimated a-priori SNR calculator 1302 has a range limitation processing unit 1401, an a-posteriori SNR storing unit 1402, a spectral gain storing unit 1403, multipliers 1404 and 1405, a weight storing unit 1406, a weighted addition unit 1407 and an adder 1408. An a-posteriori SNR $\gamma n$ (k) (k=0, 1, . . . , M−1) supplied from the a-posteriori SNR calculator 1301 is transmitted to the a-posteriori SNR storing unit 1402 and the adder 1408. The a-posteriori SNR storing unit 1402 stores therein an a-posteriori SNR $\gamma n$ (k) at the nth frame, and at the same time, transmits an a-posteriori SNR $\gamma n-1$ (k) at the (n−1)th frame to the multiplier 1405.

The spectral gain storing unit 1403 stores therein a spectral gain Gn (k) bar at the nth frame, and at the same time, transmits a spectral gain Gn−1 (k) bar at the (n−1)th frame to the multiplier 1404. The multiplier 1404 calculates a Gn−12 (k) bar by multiplying a supplied Gn−1 (k) bar by itself, and transmits the Gn−12 (k) bar to the multiplier 1405. The multiplier 1405 calculates a Gn−12 (k) bar $\gamma n-1$ (k) by multiplying the Gn−12 (k) bar by the $\gamma n-1$ (k) at k=0, 1, . . . , M−1, and transmits the calculation result to the weighted addition unit 1407 as a past estimated SNR 922.

Another terminal of the adder 1408 is supplied with "−1", and an addition result $\gamma n$ (k)−1 is transmitted to the range limitation processing unit 1401. The range limitation processing unit 1401 performs an arithmetic operation using a range limitation operator P [*] on the addition result γn (k)−1 supplied from the adder 1408, and transmits the resultant P [γn (k)−1] to the weighted addition unit 1407 as an instantaneous estimated SNR 921. In addition, P [*] is determined by the following equation (11).

$$P[x] = \begin{cases} x, & x > 0 \\ 0, & x \le 0 \end{cases} \tag{11}$$

The weighted addition unit 1407 is further supplied with a weight 923 from the weight storing unit 1406. The weighted addition unit 1407 calculates an estimated a-priori SNR 924 by using these supplied instantaneous estimated SNR 921, past estimated SNR 922 and weight 923. Supposing that the weight 923 and ξn (k) hat correspond to α and an estimated a-priori SNR, respectively, the ξn (k) hat can be calculated by using the following equation (12). Herein, it is supposed that a equation: Gn−12 (k) γ−1 (k) bar=1 is satisfied.

$$\hat{\xi}_n(k)=\alpha\gamma_{n-1}(k)\overline{G}_{n-1}^2(k)+(1-\alpha)P[\gamma_n(k)-1] \tag{12}$$

Figure 15:
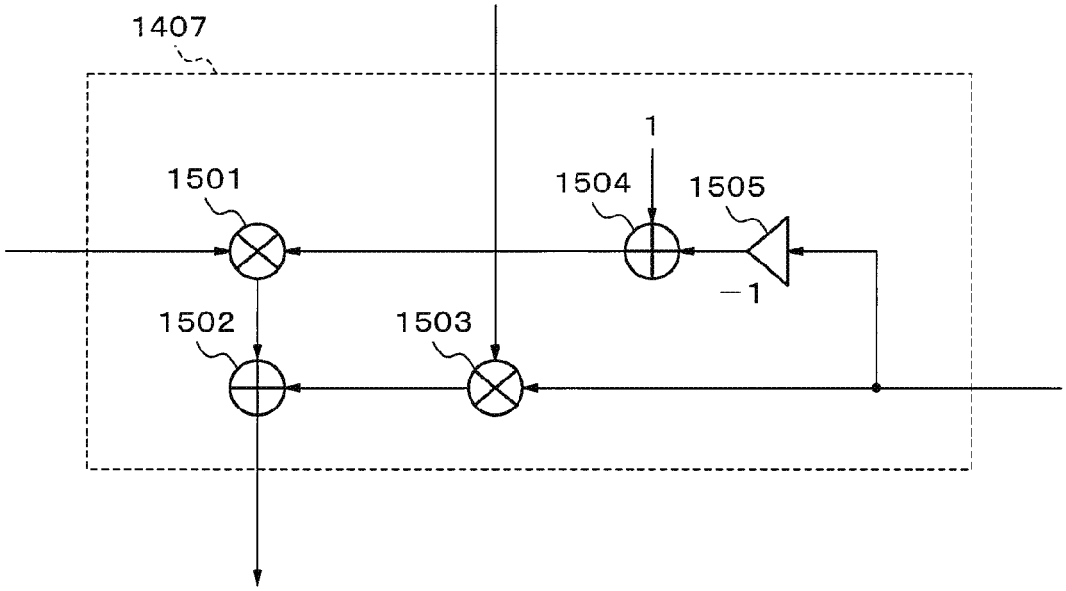
FIG. 15 is a block diagram illustrating a configuration of an weighted addition unit according to a fifth exemplary embodiment of the present invention.

FIG. 15 is a block diagram illustrating a configuration of the weighted addition unit 1407 included in FIG. 14. The weighted addition unit 1407 has multipliers 1501 and 1503, a fixed number multiplier 1505 and adders 1502 and 1504. The weighted addition unit 1407 is supplied, as inputs, with a frequency-band-dependent instantaneous estimated SNR from the range limitation processing unit 1401 shown in FIG. 14, a past frequency-band-dependent SNR from the multiplier 1405 shown in FIG. 14 and a weight from the weight storing unit 1406 shown in FIG. 14. The weight having the value α is transmitted to the fixed number multiplier 1505 and the multiplier 1503. The fixed number multiplier 1505 transmits "−α" resulting from multiplying an input signal by "−1" to the adder 1504. Further, another input of the adder 1504 is supplied with "1", so that the output of the adder 1504 becomes "1−α" which is the sum of the both. Further, "1−α" is supplied to the multiplier 1501, and there, is multiplied by another input, that is, a frequency-band-dependent instantaneous estimated SNRP [γn (k)−1], so that its product, that is, (1−α)P[γn (k)−1], is transmitted to the adder 1502. Meanwhile, in the multiplier 1503, α having been supplied as a weight is multiplied by the past estimated SNR, and its product, that is, αGn−12 (k) bar γn−1 (k), is transmitted to the adder 1502. The adder 1502 outputs the sum of (1−α)P[γn (k)−1] and αGn−12 (k) bar γn−1 (k) as a frequency-band-dependent estimated a-priori SNR.

Figure 16:
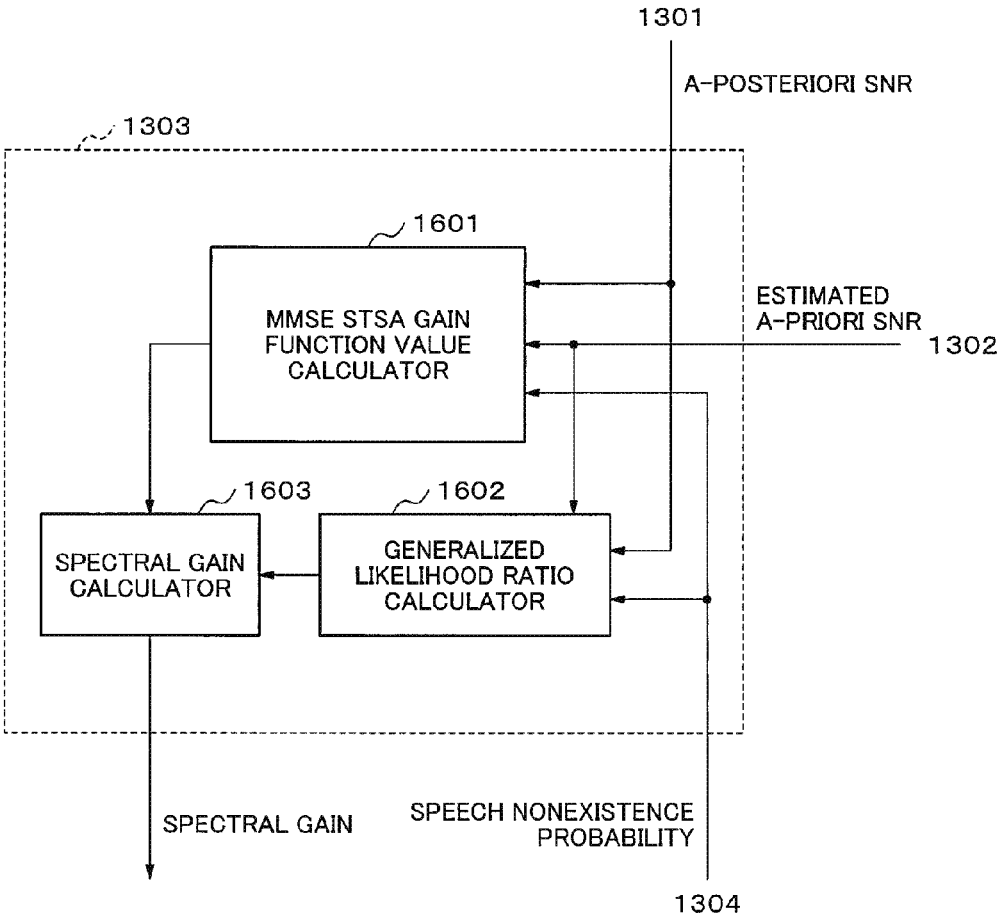
FIG. 16 is a block diagram illustrating a configuration of a noise spectral gain calculator according to a fifth exemplary embodiment of the present invention.

FIG. 16 is a block diagram illustrating the noise spectral gain calculator 1303 included in FIG. 16. The noise spectral gain calculator 1303 includes an MMSE STSA gain function value calculator 1601, a generalized likelihood ratio calculator 1602 and a spectral gain calculator 1603. Hereinafter, a method for calculating a spectral gain will be described on the basis of calculation equations which are described in IEEE TRANSACTIONS ON ACOUSTICS, SPEECH, AND SIGNAL PROCESSING, Vol. 32, No. 6, pp. 1109-1121, December 1984.

Here, it is supposed that N represents a frame number, and k represents a frequency number. Further, it is supposed that γn (k) represents a frequency-dependent a-posteriori SNR supplied from the a-posteriori SNR calculator 1301; ξn (k) hat represents a frequency-dependent estimated a-priori SNR supplied from the estimated a-priori SNR calculator 1302; and q represents a speech nonexistence probability supplied from the speech nonexistence probability storing unit 1304.

Further, it is supposed that the following equations are satisfied: ηn (k)=ξn (k) hat/(1−q), and vn (k)=(ηn (k) γn (k))/(1+ηn (k)).

The MMSE STSA gain function value calculator 1601 calculates an MMSE STSA gain function value for each frequency band on the basis of the a-posteriori SNR γn (k) supplied from the a-posteriori SNR calculator 1301, the estimated a-priori SNR ξn (k) hat supplied from the estimated a-priori SNR calculator 1302, and the speech nonexistence probability q supplied from the speech nonexistence probability storing unit 1304, and the MMSE STSA gain function value calculator 1601 outputs the calculated MMSE STSA gain function value to the spectral gain calculator 1603. The MMSE STSA gain function value Gn (k) for each frequency band is given by the following equation (13).

$$G_n(k) = \frac{\sqrt{\pi}}{2}\frac{\sqrt{v_n(k)}}{\gamma_n(k)+1}\exp\left(-\frac{v_n(k)}{2}\right)\left[(1+v_n(k))I_0\left(\frac{v_n(k)}{2}\right)+v_n(k)I_1\left(\frac{v_n(k)}{2}\right)\right] \tag{13}$$

Here, I0 (z) is a zero-order modified Bessel function, and I1 (z) is a first-order modified Bessel function. The modified Bessel function is described in "Iwanami Sugaku Jiten" (written in Japanese), Iwanami Shoten, Publishers, 374. G page (its English version is Encyclopedic Dictionary of Mathematics).

The generalized likelihood ratio calculator 1602 calculates a generalized likelihood ratio for each frequency band on the basis of the a-posteriori SNR γn (k) supplied from the a-posteriori SNR calculator 1301, the estimated a-priori SNR ξn (k) hat supplied from the estimated a-priori SNR calculator 1302, and the speech nonexistence probability q supplied from the speech nonexistence probability storing unit 1304, and transmits the generalized likelihood ratio to the spectral gain calculator 1603. The generalized likelihood ratio Λn (k) for each frequency band is given by the following equation (14).

$$\Lambda_n(k) = \frac{1-q}{q}\frac{\exp(v_n(k))}{1+\eta_n(k)} \tag{14}$$

The spectral gain calculator 1603 calculates a spectral gain for each frequency band from the MMSE STSA gain function value Gn (k) supplied from the MMSE STSA gain function value calculator 1601, and the generalized likelihood ratio Λn (k) supplied from the generalized likelihood ratio calculator 1602. A spectral gain Gn (k) bar for each frequency band is given by the following equation (15).

$$\overline{G}_n(k) = \frac{\Lambda_n(k)}{q\Lambda_n(k)+1}G_n(k) \tag{15}$$

The spectral gain calculator 1603 may calculate an SNR common to a wide frequency band including a plurality of frequency bands, and may use this SNR instead of calculating SNRs for the respective frequency bands.

Through the above-described configuration, in the noise suppression using the spectral gain, similarly, control is performed such that a noise level is made small in accordance with a ratio of a desired signal level and the noise level, thereby enabling realization of signal processing with high quality. That is, according to this exemplary embodiment, it is also possible to realize signal processing with high quality by leaving important signal components as they are, just like in the case of the second exemplary embodiment, and further, it is possible to perform a more accurate noise suppression.

Sixth Exemplary Embodiment

Figure 17:
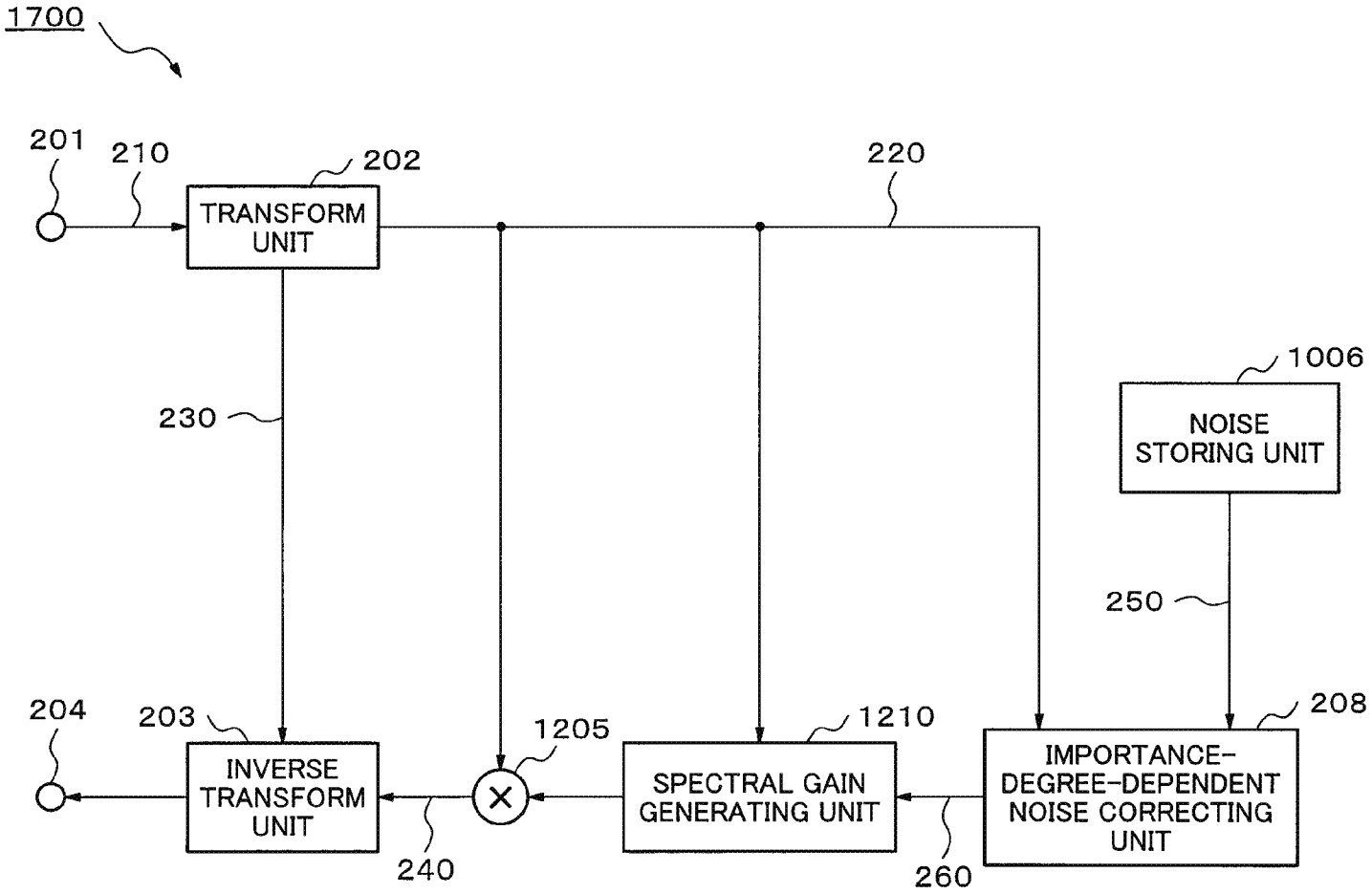
FIG. 17 is a block diagram illustrating a configuration of a noise suppression device according a sixth exemplary embodiment of the present invention.

FIG. 17 is a block diagram illustrating a schematic configuration of a noise suppression device 1700 as a sixth exemplary embodiment of the present invention. The noise suppression device 1700 according to this exemplary embodiment is configured to, unlike in the case of the fifth exemplary embodiment, include the noise storing 1006 having been described in the third exemplary embodiment as a substitute for the noise estimating unit 206. Since other components and operations thereof are the same as those of the fifth exemplary embodiment, the same components as those of the fifth exemplary embodiment are denoted by the same corresponding reference signs as those thereof, and detailed description thereof is omitted here.

According to this exemplary embodiment, just like in the case of the fifth exemplary embodiment, it is also possible to realize signal processing with high quality by leaving important signal components as they are.

Seventh Exemplary Embodiment

Figure 18:
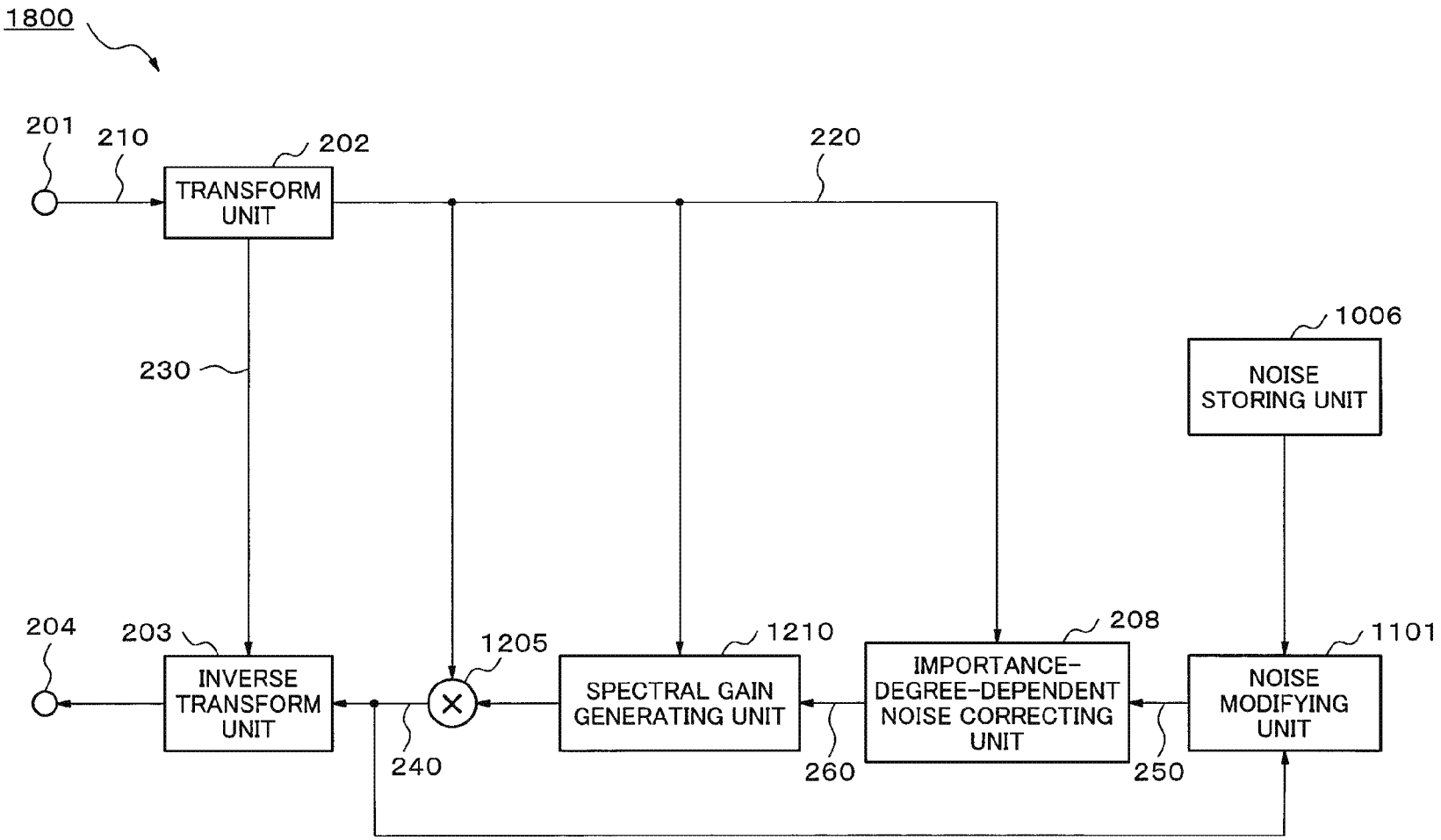
FIG. 18 is a block diagram illustrating a configuration of a noise suppression device according to a seventh exemplary embodiment of the present invention.

FIG. 18 is a block diagram illustrating a schematic configuration of a noise suppression device 1800 as a seventh exemplary embodiment of the present invention. The noise suppression device 1800 according to this exemplary embodiment is configured to, unlike in the case of the sixth exemplary embodiment, cause the noise modifying unit 1101 to perform modification on the output from the noise storing unit 1006, and supplies the modified noise information 250 to the importance-degree-dependent noise correcting unit 208.

The noise modifying unit 1101 receives the output 240 from the noise suppressing unit 1205, and modifies noise in accordance with the feedback of the noise suppression result.

Since other components and operations thereof are the same as those of the sixth exemplary embodiment, the same components as those of the sixth exemplary embodiment are denoted by the same corresponding reference signs as those thereof, and detailed description thereof is omitted here.

According to this exemplary embodiment, it is also possible to realize signal processing with high quality by leaving important signal components as they are, just like in the case of the sixth exemplary embodiment, and further, it is possible to perform a more accurate noise suppression.

Eighth Exemplary Embodiment

Figure 19:
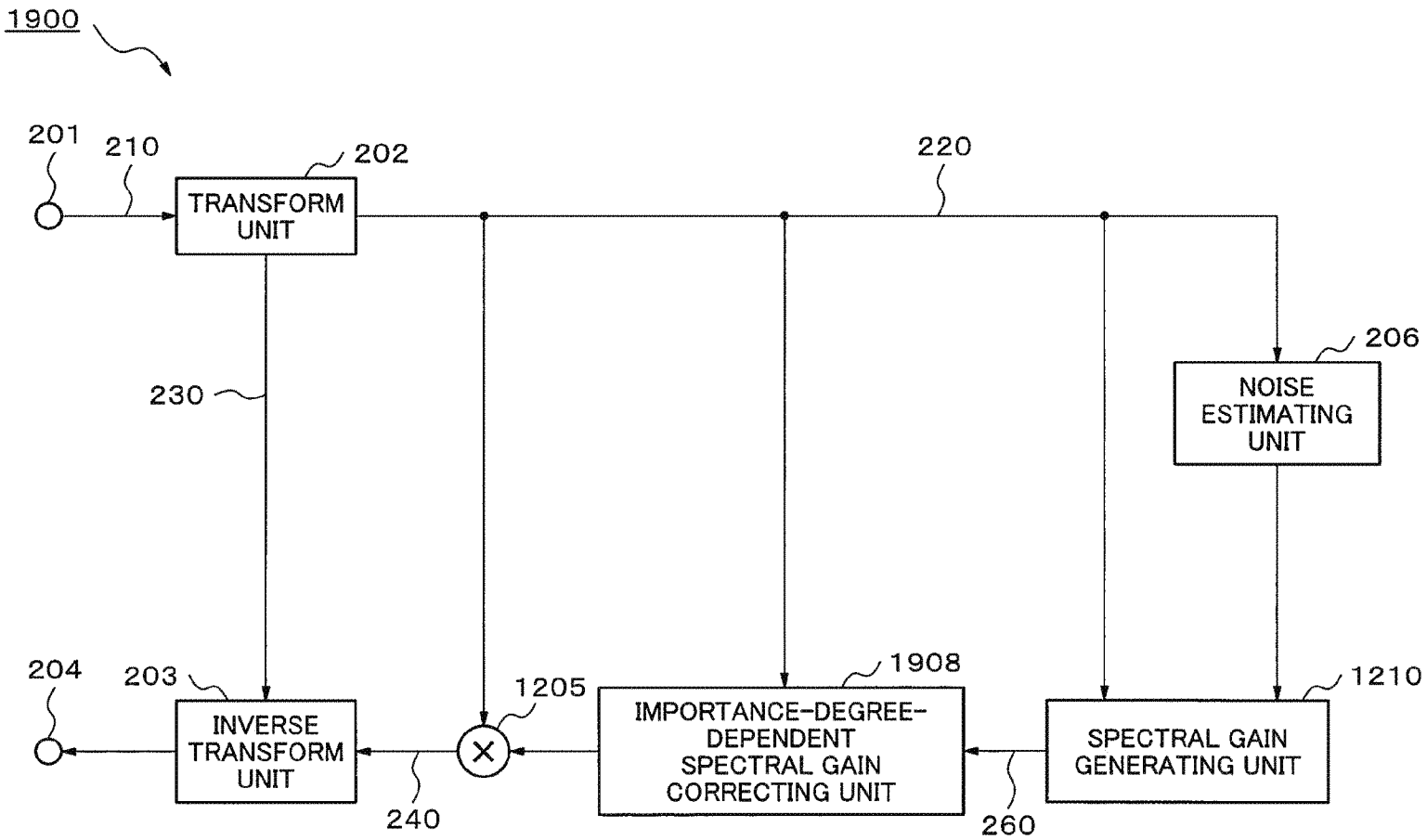
FIG. 19 is a block diagram illustrating a configuration of a noise suppression device according to an eighth exemplary embodiment of the present invention.

FIG. 19 is a block diagram illustrating a schematic configuration of a noise suppression device 1900 as an eighth exemplary embodiment of the present invention. When comparing FIG. 12 and FIG. 19, the noise suppression device 1900 according to this exemplary embodiment does not include the importance-degree-dependent noise correcting unit 208, unlike in the case of the fifth exemplary embodiment, and, as a substitute therefor, includes an important-degree-dependent spectral gain correcting unit 1908 which corrects the spectral gains supplied from the spectral gain generating unit 1210 in accordance with corresponding important degrees. Since other components and operations thereof are the same as those of the fifth exemplary embodiment, the same components as those of the fifth exemplary embodiment are denoted by the same corresponding reference signs as those thereof, and detailed description thereof is omitted here.

The important-degree-dependent spectral gain correcting unit 1908 corrects the spectral gains generated by the spectral gain generating unit 1210 in accordance with corresponding important degrees of input signals (frequency bins). Specifically, the important-degree-dependent spectral gain correcting unit 1908 is configured such that each of the noise correcting units 252, 253, 272 and 282 having been described in FIGS. 2B to 2G is changed to a spectral gain correcting unit, and performs similar corrections on inputted spectral gains which are substitutes for the inputted noise information.

In this way, the noise suppression device 1900 makes spectral gains small with respect to corresponding important frequency component signals, and thereby inhibits corresponding signal suppressions in the noise suppressing unit 1205.

Through the above-described configuration, in the noise suppression using the spectral gain, similarly, control is performed such that spectral gains are made small in accordance with corresponding ratios of desired signal levels and noise levels, thereby enabling realization of signal processing with high quality. That is, according to this exemplary embodiment, it is also possible to realize signal processing with high quality by leaving important signal components as they are, just like in the case of the second exemplary embodiment, and further, it is possible to perform a more accurate noise suppression.

Ninth Exemplary Embodiment

Figure 20:
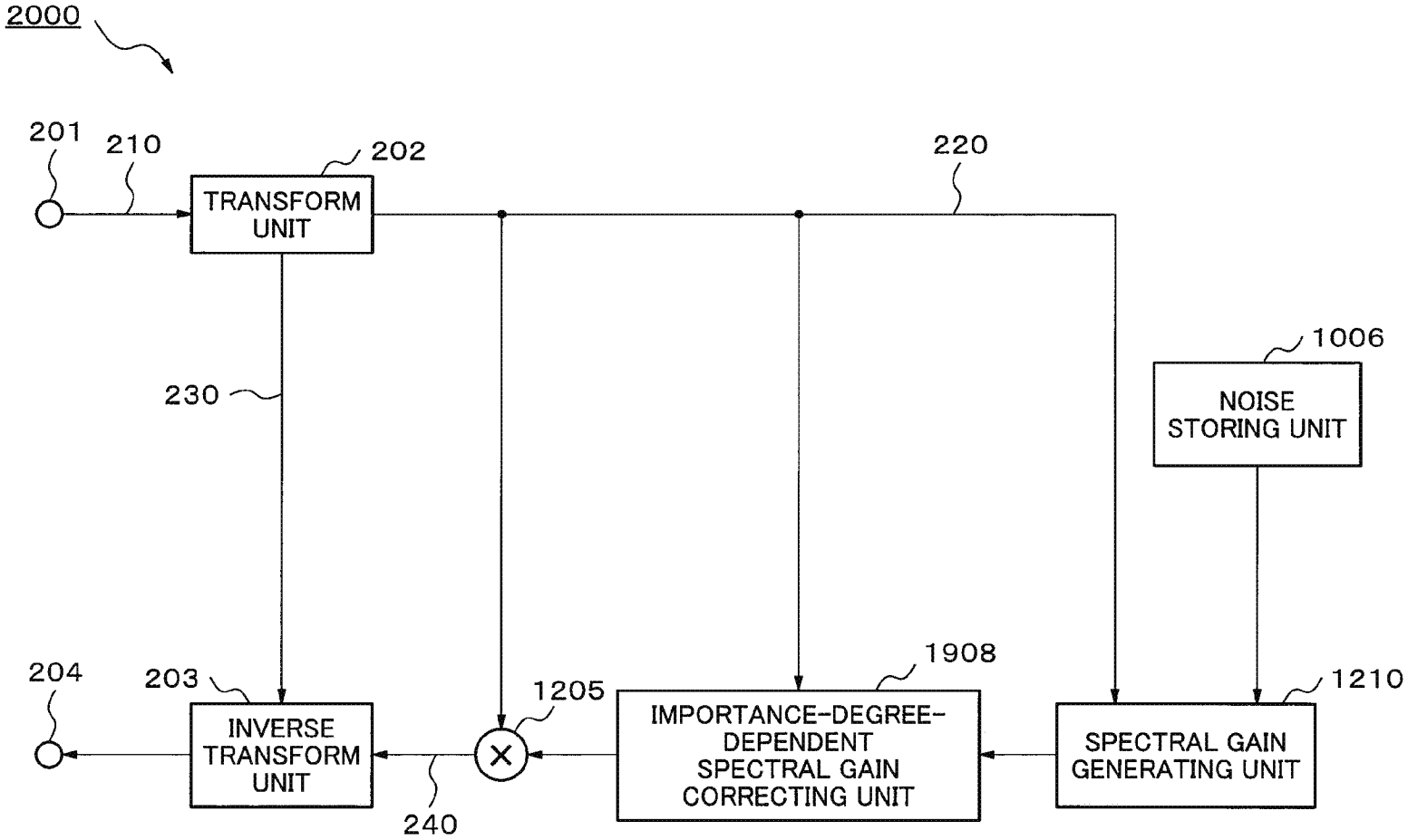
FIG. 20 is a block diagram illustrating a configuration of a noise suppression device according to a ninth exemplary embodiment of the present invention.

FIG. 20 is a block diagram illustrating a schematic configuration of a noise suppression device 2000 as a ninth exemplary embodiment of the present invention. The noise suppression device 2000 according to this exemplary embodiment is configured to, unlike in the case of the eighth exemplary embodiment, include the noise storing 1006 having been described in the third exemplary embodiment as a substitute for the noise estimating unit 206. Since other components and operations thereof are the same as those of the eighth exemplary embodiment, the same components as those of the eighth exemplary embodiment are denoted by the same corresponding reference signs as those thereof, and detailed description thereof is omitted here.

According to this exemplary embodiment, just like in the case of the eighth exemplary embodiment, it is also possible to realize signal processing with high quality by leaving important signal components as they are.

Tenth Exemplary Embodiment

Figure 21:
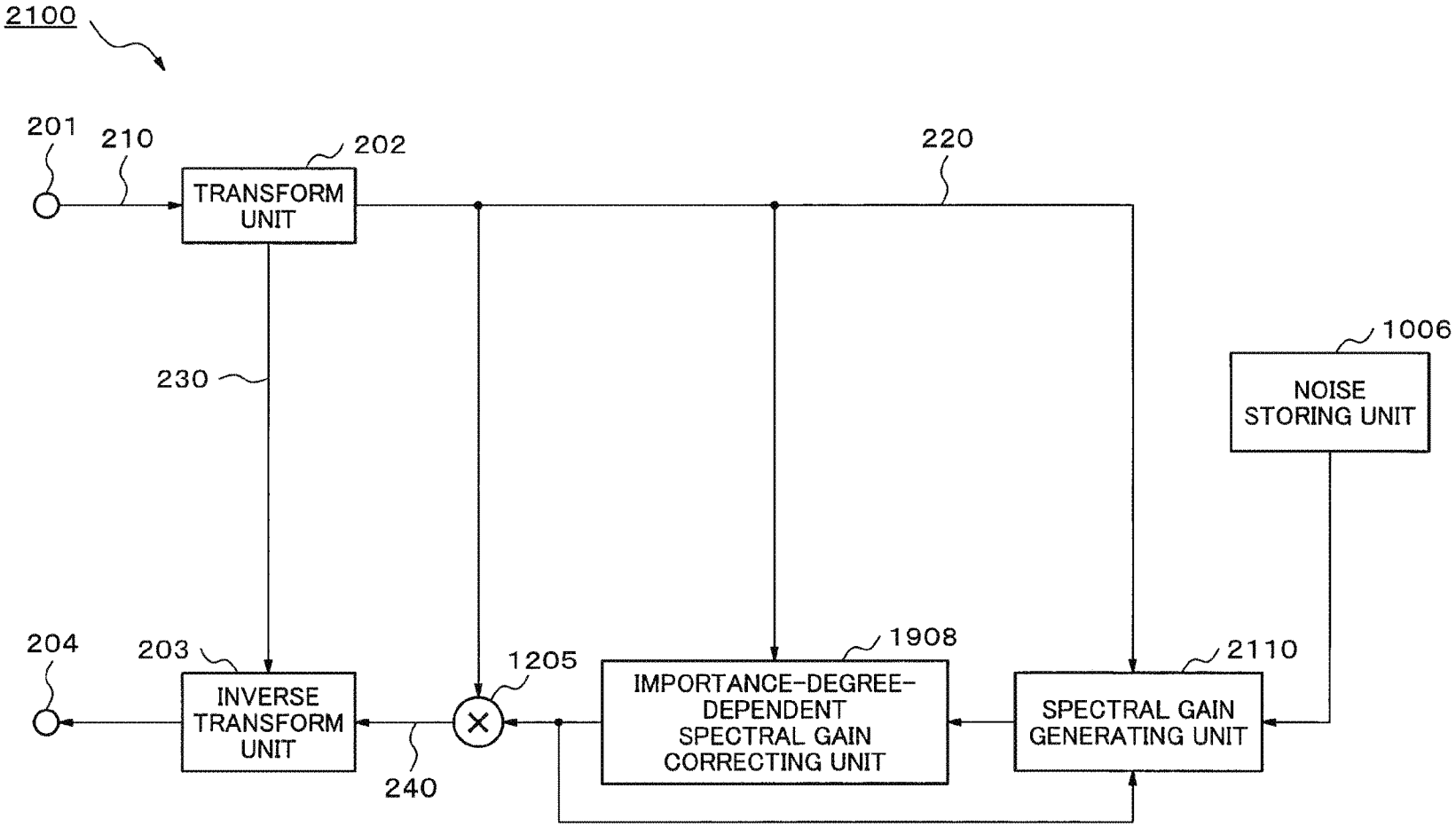
FIG. 21 is a block diagram illustrating a configuration of a noise suppression device according to a tenth exemplary embodiment of the present invention.

FIG. 21 is a block diagram illustrating a schematic configuration of a noise suppression device 2100 as a tenth exemplary embodiment of the present invention. The noise suppression device 2100 according to this exemplary embodiment is configured such that, unlike in the case of the ninth exemplary embodiment, the spectral gain resulting from the correction is fed back to a spectral gain generating unit 2110. The spectral gain generating unit 2110 generates a next spectral gain by using the fed-back spectral gain. This operation increases the accuracy of the spectral gain, and thus, leads to the improvement of a sound quality.

Since other components and operations thereof are the same as those of the ninth exemplary embodiment, the same components as those of the ninth exemplary embodiment are denoted by the same corresponding reference signs as those thereof, and detailed description thereof is omitted here.

According to this exemplary embodiment, it is also possible to realize signal processing with high quality by leaving important signal components as they are, just like in the case of the ninth exemplary embodiment, and further, it is possible to perform a more accurate noise suppression.

Eleventh Exemplary Embodiment

Figure 22:
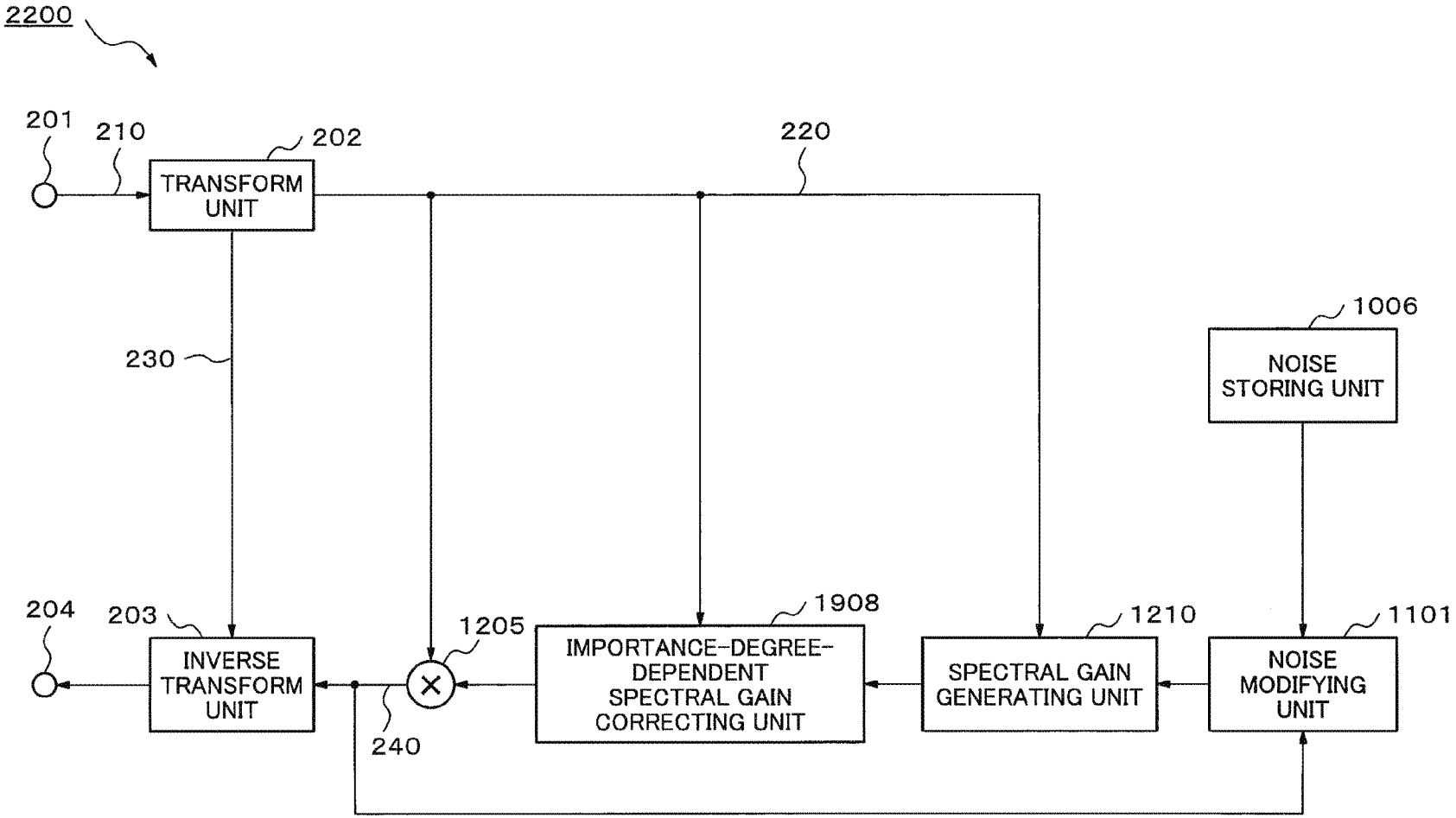
FIG. 22 is a block diagram illustrating a configuration of a noise suppression device according to an eleventh exemplary embodiment of the present invention.

FIG. 22 is a block diagram illustrating a schematic configuration of a noise suppression device 2200 as an eleventh exemplary embodiment of the present invention. The noise suppression device 2200 according to this exemplary embodiment is configured to, unlike in the case of the ninth exemplary embodiment, cause the noise modifying unit 1101 to perform modification on the output from the noise storing unit 1006, and supplies the modified noise information 250 to the spectral gain generating unit 1210.

The noise modifying unit 1101 receives the output 240 from the noise suppressing unit 1205, and modifies noise in accordance with the feedback of the noise suppression result.

Since other components and operations thereof are the same as those of the ninth exemplary embodiment, the same components as those of the ninth exemplary embodiment are denoted by the same corresponding reference signs as those thereof, and detailed description thereof is omitted here.

According to this exemplary embodiment, it is also possible to realize signal processing with high quality by leaving important signal components as they are, just like in the case of the ninth exemplary embodiment, and further, it is possible to perform a more accurate noise suppression.

Twelfth Exemplary Embodiment

Figure 23:
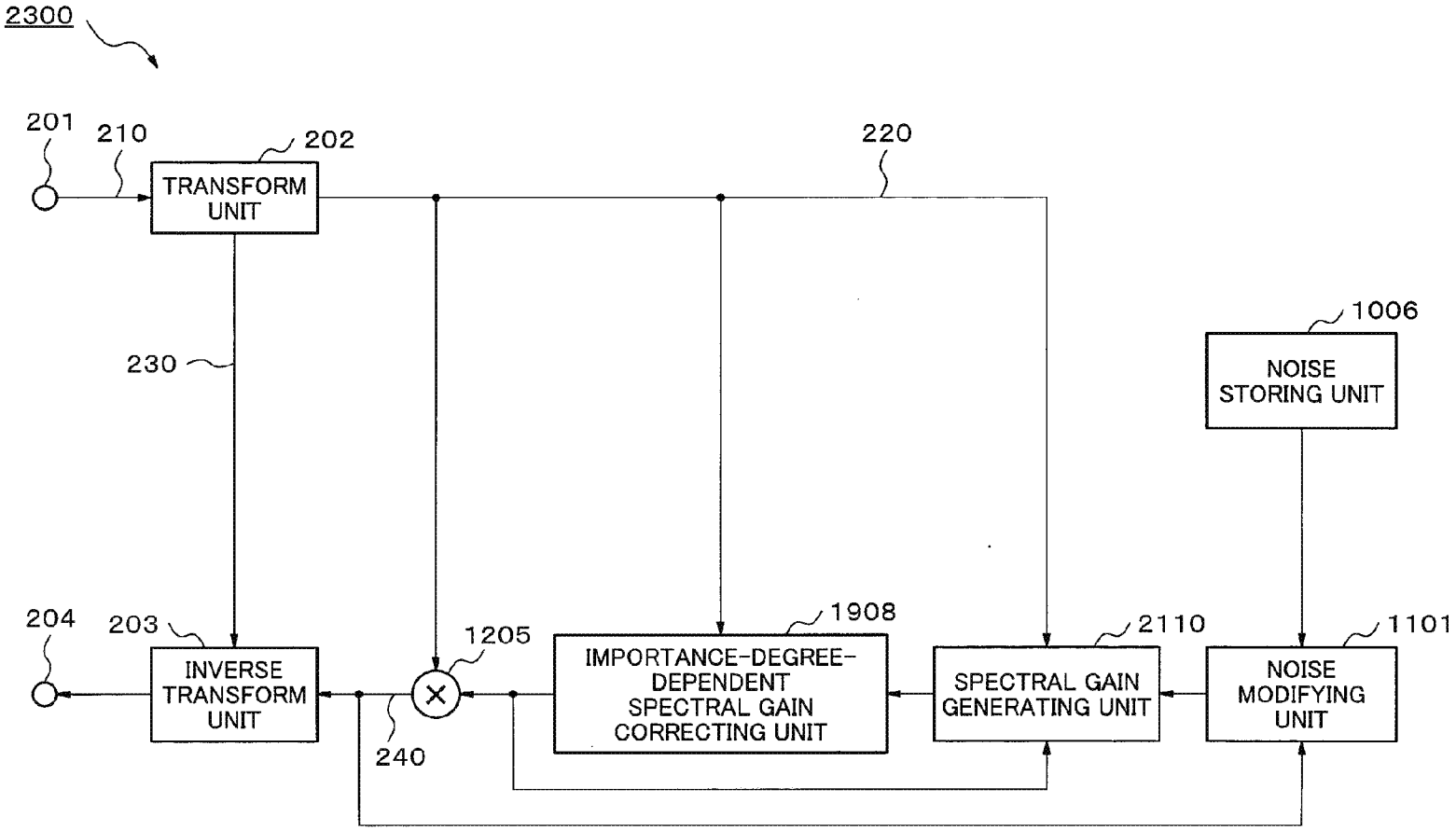
FIG. 23 is a block diagram illustrating a configuration of a noise suppression device according to a twelfth exemplary embodiment of the present invention.

FIG. 23 is a block diagram illustrating a schematic configuration of a noise suppression device 2200 as a twelfth exemplary embodiment of the present invention. The noise suppression device 2200 according to this exemplary embodiment is configured such that, unlike in the case of the ninth exemplary embodiment, the spectral gain resulting from the correction is fed back to a spectral gain generating unit 2110. The spectral gain generating unit 2110 generates a next spectral gain by using the fed-back spectral gain. This operation increases the accuracy of the spectral gain, and thus, leads to the improvement of a sound quality. Moreover, the noise suppression device 2200 according to this exemplary embodiment causes the noise modifying unit 1101 to perform modification on the output from the noise storing unit 1006, and supplies the modified noise information 250 to the spectral gain generating unit 2110. The noise modifying unit 1101 receives the output 240 from the noise suppressing unit 1205, and modifies noise in accordance with the feedback of the noise suppression result.

Since other components and operations thereof are the same as those of the ninth exemplary embodiment, the same components as those of the ninth exemplary embodiment are denoted by the same corresponding reference signs as those thereof, and detailed description thereof is omitted here.

According to this exemplary embodiment, it is also possible to realize signal processing with high quality by leaving important signal components as they are, just like in the case of the ninth exemplary embodiment, and further, it is possible to perform a more accurate noise suppression.

Other Embodiments

In the first to twelfth exemplary embodiments above, the noise suppression devices having respective different features have been described, but noise suppression devices each resulting from combining the features arbitrarily are also included in the category of the present invention.

Further, the present invention may be applied to a system including a plurality of devices, and may be also applied to a single device. Moreover, the present invention can be also applied to a case where a signal processing program for software which realizes the functions of the aforementioned exemplary embodiments is supplied to a system or a device directly or from a remote. Accordingly, in order to cause a computer to realize the functions according to aspects of the present invention, a program which is installed in the computer, as well as a medium which stores the program therein and a WWW server which allows the program to be downloaded to the computer, are also included in the category of the present invention.

Figure 24:
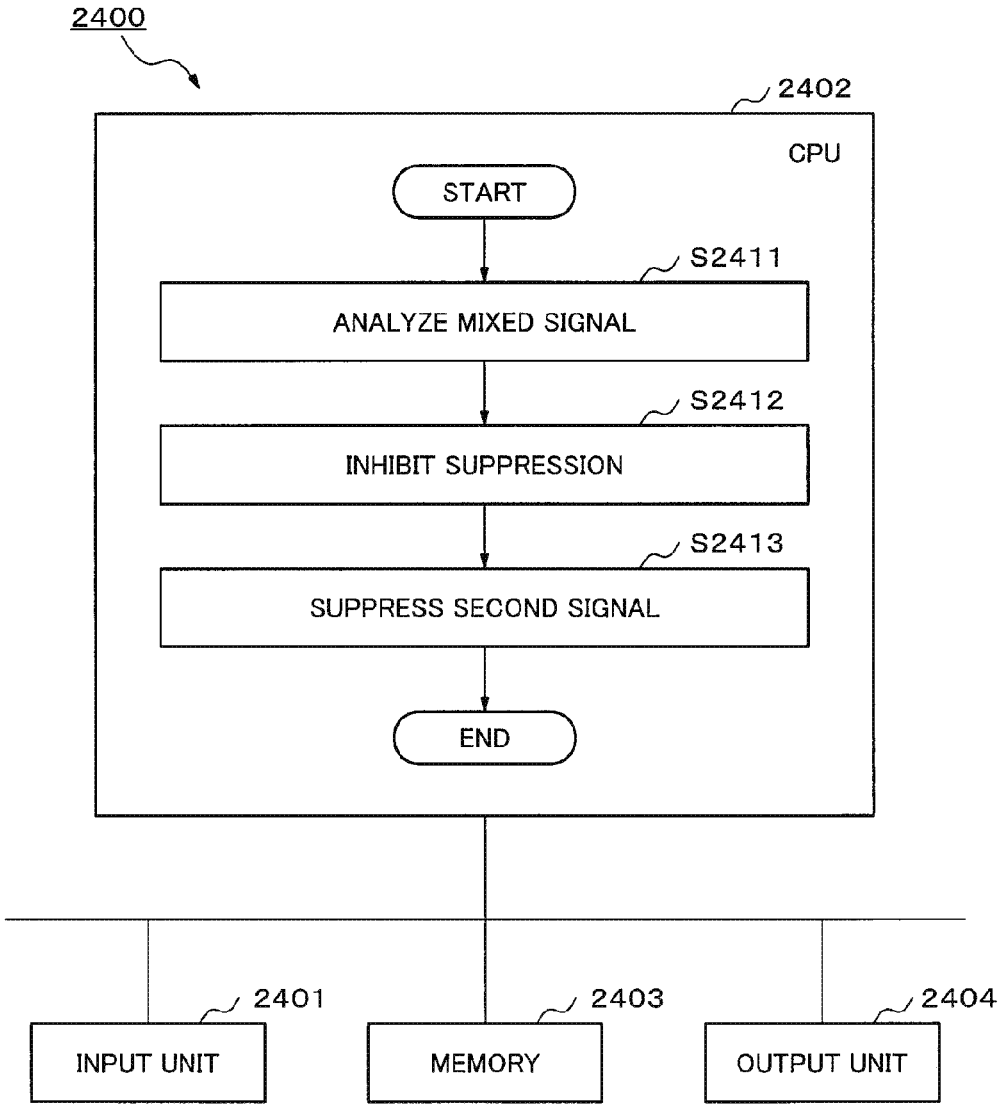
FIG. 24 is a block diagram illustrating a configuration of a noise suppression device according to one of other exemplary embodiments of the present invention.

FIG. 24 is a block diagram of a computer 2400 which executes a signal processing program in the case where the first exemplary embodiment is realized by the signal processing program. The computer 2400 includes an input unit 2401, a CPU 2402, a memory 2403 and an output unit 2404.

The CPU 2402 controls the operation of the computer 2400 by reading in a signal processing program. That is, the CPU 2402 executes a signal processing program stored in the memory 2403, and thereby analyzes importance degrees of a first signal contained in a mixed signal, in which the first signal and a second signal are mixed, for respective frequency components (S2411). Next, as the result of the analysis, the CPU 2402 performs control so as to inhibit the suppressions of the second signal on corresponding frequency components having high importance degrees to a greater degree as compared with those on frequency components having low importance degrees (S2412). Further, the CPU 2402 processes the mixed signal on the basis of the inhibition control, and thereby suppresses the second signal (S2413).

In this way, it is possible to obtain the same advantageous effects as those of the first exemplary embodiment.

Hereinbefore, the present invention has been described with reference to exemplary embodiments thereof, but the present invention is not limited to these exemplary embodiments. Various changes understandable by the skilled in the art can be made on the configuration and the details of the present invention within the scope of the present invention.

This application is based upon and claims the benefit of priority from Japanese Patent Application No. 2010-263023, filed on Nov. 25, 2010, the disclosure of which is incorporated herein in its entirety by reference.

The invention claimed is:

1. A signal processing device comprising:

a circuitry configured to:

decompose a mixed signal containing a first signal and a second signal into multiple frequency components for performing following processing in a frequency domain;

suppress the second signal;

determine a separate importance degree of the first signal for each of the frequency components based on magnitude information alone from a viewpoint of how much degree the frequency component is likely to be perceived; and based on the determined importance degrees of the first signal, reduce a degree of the suppression of the second signal for each of the frequency components according to the determined importance degrees of the first signal.

2. The signal processing device according to claim 1, wherein said circuitry is further configured to determine at least one spectrum peak frequency as at least one frequency component having a high importance degree among said frequency components.

3. The signal processing device according to claim 2, wherein, in the case where a difference between a value corresponding to at least one first frequency and a value corresponding to a second frequency adjacent to said at least one first frequency, said value being any one of an amplitude value and a power value, is larger than a corresponding predetermined threshold value, said circuitry is further configured to determine said at least one first frequency as said at least one spectrum peak frequency.

4. The signal processing device according to claim 2, wherein said circuitry is further configured to determine at least one spectrum peak frequency, which is included in said at least one spectrum peak frequency, and which appears regularly, as said at least one frequency component having a high importance degree.

5. The signal processing device according to claim 1, wherein said circuitry is further configured to determine at least one frequency, at which any one of an amplitude value and a power value is larger than a corresponding predetermined threshold value, as at least one frequency component having a high importance degree among said frequency components.

6. The signal processing device according to claim 1, wherein said circuitry is further configured to determine at least one spectrum peak frequency, at which any one of an amplitude value and a power value is larger than a corresponding predetermined threshold value, as at least one frequency component having a high importance degree among said frequency components.

7. The signal processing device according to claim 1 wherein said circuitry is further configured to estimate said second signal mixed in said mixed signal, and performs said suppression on said mixed signal by using said estimated second signal, and correct values of said estimated second signal for respective frequency components on the basis of a result of said determined importance degree of said first signal for each of said frequency components, such that a value of said estimated second signal corresponding to at least one frequency component having a high importance degree among said frequency components is corrected to a smaller degree, as compared with a value of said estimated second signal corresponding to at least one frequency component having a low importance degree among said frequency components.

8. The signal processing device according to claim 1, wherein said circuitry is further configured to store therein in advance said second signal, which is estimated to be mixed in said mixed signal, as a stored second signal, and performing said suppression on said mixed signal by using said stored second signal, and perform correction of values of said stored second signal for respective frequency components on the basis of a result of said determined importance degree of said first signal for each of said frequency components, such that a value of said stored second signal corresponding to at least one frequency component having a high importance degree among said frequency components is corrected to a smaller degree, as compared with a value of said stored second signal corresponding to at least one frequency component having a low importance degree among said frequency components.

9. The signal processing device according to claim 1, wherein said circuitry is further configured to suppress said second signal mixed in said mixed signal by multiplying said mixed signal by spectral gains for respective frequency components, and perform correction of values of said spectral gains for respective frequency components such that a value of a spectral gain corresponding to at least one frequency component having a high importance degree among said frequency components is corrected to a smaller degree, as compared with a value of a spectral gain corresponding to at least one frequency component having a low importance degree among said frequency components.

10. The signal processing device according to claim 1, wherein said second signal is noise, and said circuitry is further configured to perform correction of values of estimated noise for respective frequency components, said estimated noise being used for said suppression performed by said circuitry, such that a value of said estimated noise corresponding to at least one frequency component having a high importance degree among said frequency components is corrected to a smaller degree, as compared with a value of said estimated noise corresponding to at least one frequency component having a low importance degree among said frequency components.

11. A signal processing method comprising: by a circuitry, decomposing a mixed signal containing a first signal and a second signal into multiple frequency components for performing following processing in a frequency domain;

determine a separate importance degree of the first signal for each of the frequency components based on magnitude information alone from a viewpoint of how much degree the frequency component is likely to be perceived; and when suppressing the second signal for each of the frequency components, reducing, based on the determined importance degrees of the first signal, a degree of the suppression of the second signal according to the determined importance degrees of the first signal.

12. A computer readable non-transitory medium for storing a signal processing program operable on a computer which function as a signal processing device, the signal processing program causes the computer to execute:

a frequency decomposition processing of decomposing a mixed signal containing a first signal and a second signal into multiple frequency components for performing following processing in a frequency domain;

a suppression processing of suppressing the second signal by processing the mixed signal;

an analysis processing of determining a separate importance degree of the first signal for each of the frequency components based on magnitude information alone from a viewpoint of how much degree the frequency component is likely to be perceived; and a processing of reducing, based on the determined importance degrees of the first signal, the suppression of the second signal for each of the frequency components according to the determined importance degrees of the first signal.

* * * * *